US006699647B2

(12) United States Patent
Lynch et al.

(10) Patent No.: US 6,699,647 B2
(45) Date of Patent: Mar. 2, 2004

(54) HIGH SPEED PHOTOTHERMOGRAPHIC MATERIALS CONTAINING TELLURIUM COMPOUNDS AND METHODS OF USING SAME

(75) Inventors: Doreen C. Lynch, Afton, MN (US); Andrea L. Opatz, Woodbury, MN (US); Steven M. Shor, Brussels (BE); Sharon M. Simpson, Lake Elmo, MN (US); Brian C. Willett, Stillwater, MN (US); Henry J. Gysling, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/975,909

(22) Filed: Oct. 11, 2001

(65) Prior Publication Data

US 2002/0164549 A1 Nov. 7, 2002

Related U.S. Application Data

(63) Continuation-in-part of application No. 09/746,400, filed on Dec. 21, 2000, now abandoned.

(51) Int. Cl.[7] ..... G03C 1/498; G03C 1/09

(52) U.S. Cl. ..... 430/350; 430/264; 430/600; 430/603; 430/613; 430/619; 430/964; 430/965

(58) Field of Search ..... 430/600, 603, 430/613, 619, 965, 264, 964, 350

(56) References Cited

U.S. PATENT DOCUMENTS

| | | | | |
|---|---|---|---|---|
| 3,655,394 A | | 4/1972 | Illingsworth | |
| 4,036,650 A | | 7/1977 | Hasegawa et al. | |
| 4,144,062 A | | 3/1979 | Lelental et al. | |
| 4,188,218 A | | 2/1980 | Gysling | |
| 4,251,623 A | | 2/1981 | Gysling | |
| 4,639,414 A | | 1/1987 | Sakaguchi | |
| 5,273,874 A | | 12/1993 | Kojima et al. | |
| 5,459,027 A | | 10/1995 | Takada et al. | |
| 5,498,511 A | | 3/1996 | Yamashita et al. | |
| 5,677,120 A | | 10/1997 | Lushington et al. | |
| 5,686,228 A | * | 11/1997 | Murray et al. | 430/350 |
| 5,759,760 A | | 6/1998 | Lushington et al. | |
| 5,763,154 A | | 6/1998 | Gysling et al. | |
| 5,891,615 A | * | 4/1999 | Winslow et al. | 430/603 |
| 5,922,529 A | | 7/1999 | Tsuzuki et al. | |
| 5,968,725 A | | 10/1999 | Katoh et al. | |
| 6,025,122 A | | 2/2000 | Sakai et al. | |
| 6,100,022 A | | 8/2000 | Inoue et al. | |
| 6,187,528 B1 | * | 2/2001 | Uytterhoeven et al. | 430/619 |
| 6,368,779 B1 | * | 4/2002 | Lynch et al. | 430/619 |

FOREIGN PATENT DOCUMENTS

| | | |
|---|---|---|
| EP | 1 070 986 A1 | 1/2001 |
| JP | 56-19618 | 5/1981 |
| JP | 07-128768 | 5/1995 |
| JP | 9-43766 | 2/1997 |

OTHER PUBLICATIONS

JP Abstract 53143216.
JP Abstract 53142222.
JP Abstract 52064925.
JP Abstract 9–311407.
JP Abstract 9–297370.
JP Abstract 11–352627.
JP Abstract 51–85721.
"Research Disclosure", Item 16655, Feb. 1978, Lelental & Gysling.
JP Abstract 07–128768.

* cited by examiner

*Primary Examiner*—Thorl Chea
(74) *Attorney, Agent, or Firm*—J. Lanny Tucker; Louis M. Leichter

(57) ABSTRACT

Photothermographic imaging materials having increased photospeed are provided by certain tellurium chemical sensitizers that are added during the formulation of a photothermographic emulsion. These useful chemical sensitizers are represented by the following Structure I or II:

$$Te(L)_m(X^1)_n \quad (I)$$

$$Pd(X^2)_2[Te(R')_2]_2 \quad (II)$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)_2$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different groups.

51 Claims, No Drawings

HIGH SPEED PHOTOTHERMOGRAPHIC MATERIALS CONTAINING TELLURIUM COMPOUNDS AND METHODS OF USING SAME

CROSS REFERENCE TO RELATED APPLICATION

Continuation-in-part (CIP) of prior application Ser. No. 09/746,400 filed Dec. 21, 2000, now abandoned.

FIELD OF THE INVENTION

This invention relates to thermally-developable imaging materials such as photothermographic materials that exhibit high speed imaging characteristics. In particular, this invention relates to the use of certain tellurium compounds as chemical sensitizers in photothermographic materials to provide increased photothermographic speed. This invention also relates to methods of imaging using these photothermographic materials.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet or infrared radiation) and developed by the use of thermal energy. These materials, also known as "dry silver" materials, generally comprise a support having coated thereon: (a) photosensitive catalyst (such as silver halide) that upon such exposure provides a latent image in exposed grains that is capable of acting as a catalyst for the subsequent formation of a silver image in a development step, (b) a non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms, $(Ag^0)_n$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms [Klosterboer, *Imaging Processes and Materials* (*Neblette's Eighth Edition*), J. Sturge, V. Walworth & A. Shepp (Eds.), Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide, have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi,* 1994, 11, 992–997, and FR 2,254,047 (Robillard)].

The photosensitive silver halide may be made "in situ," for example, by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Usanov et al., *J. Imaging Sci. Tech.* 1996, 40, 104]. Alternatively, a portion of the reducible silver ions can be completely converted to silver halide, and that portion can be added back to the source of reducible silver ions (see Usanov et al., International Conference on Imaging Science, Sep. 7–11, 1998).

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to, and be present during, the formation of the source of reducible silver ions. Co-precipitation of the silver halide and the source of reducible silver ions provides a more intimate mixture of the two materials [see for example, U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles, and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms, $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver containing-clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography", the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is, in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in Zou et al., *J Imaging Sci. Technol.* 1996, 40, pp. 94–103, and in M. R. V. Sahyun, *J. Imaging Sci. Technol.* 1998, 42, 23.

Problem to be Solved

One of the challenges in the use of photothermographic materials is attaining sufficient photothermographic speed in such materials that are also compatible with available imaging sources.

Each of the pure photographic silver halides (silver chloride, silver bromide and silver iodide) has its own natural response to radiation, in both wavelength and speed, within the UV, near UV and blue regions of the electromagnetic spectrum. Mixtures of silver halides (for example, silver bromochloroiodide, silver chloroiodide, silver chlorobromide and silver iodobromide) also have their own natural sensitivities within the UV and blue regions of the electromagnetic spectrum. Thus, silver halide grains, when composed of only silver and halogen atoms have defined levels of sensitivity depending upon the levels of specific halogen, crystal morphology (shape and structure of the crystals or grains) and other characteristics such as, for example, crystal defects, stresses, and dislocations, and dopants incorporated within or on the crystal lattice of the silver halide. These features may or may not have been controlled or purposely introduced to affect emulsion sensitometry.

The efforts to influence silver halide grain speed in conventional wet-processed silver halide emulsions generally fall within the investigation of crystal composition, morphology or structure (all briefly described above), or the use of dopants, spectral sensitizers, supersensitizers, reduction sensitizers, and chemical sensitizers (particularly sulfur sensitizers).

Spectral sensitization is the addition of a compound (usually a dye) to silver halide grains that absorbs radiation at wavelengths (UV, visible or IR) other than those to which the silver halide is naturally sensitive, or that absorbs radiation more efficiently than silver halide (even within the regions of silver halide's natural sensitivity). It is generally recognized that spectral sensitizers extend the responses of photosensitive silver halide to longer wavelengths. After absorption of the radiation, these compounds transfer energy or electrons to the silver halide grains to cause the necessary local photoinduced reduction of silver (I) to silver (0).

Supersensitization is a process whereby the speed of spectrally sensitized silver halide is increased by the addition of still another compound that may or may not be a dye. This is not merely an additive effect of the two compounds (spectral sensitizer and supersensitizer).

Reduction sensitization is a type of chemical sensitization (described in more detail in the following paragraphs) in which other chemical species (not sulfur-containing) are deposited onto, or reacted with, the silver halide grains during grain growth and finishing. Compounds used for this purpose act as reducing agents on the silver halide grains and include, but are not limited to, stannous chloride, hydrazine, ethanolamine and thiourea oxide.

Chemical sensitization (generally sulfur-sensitization) is a process, during or after silver halide crystal formation, in which sensitization centers [for example, silver sulfide clusters such as $(Ag_2S)_n$] are introduced onto the individual silver halide grains. For example, silver sulfide specks can be introduced by direct reaction of sulfur-contributing compounds with the silver halide during various stages or after completion of silver halide grain growth. These specks usually function as shallow electron traps for the preferential formation of a latent image center. Other chalcogens (Se and Te) can function similarly. The presence of these specks increases the speed or sensitivity of the resulting silver halide grains to radiation. Sulfur-contributing compounds useful for this purpose include thiosulfates (such as sodium thiosulfate) and various thioureas (such as allyl thiourea, thiourea, triethyl thiourea and 1,1'-diphenyl-2-thiourea) as described for example, by Sheppard et al., *J. Franklin Inst.,* 1923, 196, 653 and 673, C. E. K. Mees and T. H. James, *The Theory of the Photographic Process,* $4^{th}$ Edition, 1977, pp. 152–3, and T. Tani, *Photographic Sensitivity: Theory and Mechanisms*, Oxford University Press, NY, 1995, pp. 167–176.

Another useful class of chemical sensitizers includes tetrasubstituted thioureas as described in copending and commonly assigned U.S. Ser. No. 09/667,748 (filed Sep. 21, 2000 by Lynch, Simpson, Shor, Willett, and Zou). These compounds are thioureas in which the nitrogen atoms are fully substituted with various substituents.

Another method of chemical sensitization is achieved by oxidative decomposition of a sulfur-containing spectral sensitizing dye in a photothermographic emulsion as described in U.S. Pat. No. 5,891,615 (Winslow et al.).

Chemical sensitization to increase photospeed has also been achieved by treating the silver halide grains with gold-containing ions such as tetrachloroaurate(III) or dithiocyanatoaurate (I). Preferably, the gold compounds are added in the later stages of silver halide grain formation such as during ripening. Platinum and palladium compounds are also known to have similar effects. In comparison, iridium, rhodium, and ruthenium compounds are generally used to control contrast and/or high intensity reciprocity effects rather than to increase speed.

It is well known that the various speed enhancing means just described can be used in combination as the situation requires.

As noted above, in photothermographic emulsions, the photosensitive silver halide must be in catalytic proximity to the non-photosensitive source of reducible silver ions. Because of the different emulsion making procedures and chemical environments of photothermographic emulsions, the effects achieved by compounds (such as chemical sensitizers) in conventional photographic emulsions are not necessarily possible in photothermographic emulsions.

For example, in photothermographic emulsions, two types of chemical sensitization have been used to increase speed: (a) chemical sensitization of preformed silver halide grains that are then mixed into the solution containing reducible silver ions in some manner, and (b) chemical sensitization of preformed silver halide grains that are already in intimate contact with the reducible silver ions.

In the first approach (a), many of the traditional methods (used for photographic emulsions) can be used, but for the second approach (b), quite specific methods and unique compounds are often needed. Regardless of which approach is used, there is considerable difficulty in attaining additional speed while maintaining low fog ($D_{min}$)

Tellurium chemical sensitization of photothermographic materials has been reported. For example, U.S. Pat. No. 6,025,122 (Sakai et al.) describes the use of conventional tellurides such as dibenzoyl ditelluride, and other tellurium compounds as chemical sensitizers. Similar disclosure is provided in U.S. Pat. No. 5,968,725 (Katoh et al.). It is also known to use dibenzoyl ditelluride in combination with other chemical sensitizers such as sodium thiosulfate, triarylphosphine selenides (such as, pentafluorophenyldiphenyl phosphine selenide or bis(pentafluorophenyl)phenyl phosphine selenide) and chloroauric acid in thermally-developable materials.

*Research Disclosure*, Vol. 166, pages 54–56, 1978 describes the use of organotellurium compounds in thermally developable materials, but these compounds are used to form the image, not to sensitize silver halide.

U.S. Pat. No. 4,036,650 (Hasegawa et al.) describes the use of various metallized organosulfur compounds, including certain organosulfur tellurides, as chemical sensitizers in heat-developable imaging materials.

The use of sodium thiosulfate, triarylphosphine selenides and dibenzoyl ditelluride, or mixtures thereof, as chemical sensitizers for photothermographic materials is also known. For example, U.S. Pat. No. 4,639,414 (Sakaguchi) describes the use of sodium thiosulfate to decrease fog and loss of sensitivity upon storage in a silver benzotriazole, gelatin-based photothermographic emulsion. The light-sensitive silver halide is said to be chemically sensitized in the presence of a sensitizing dye that is added after the formation of silver halide but before the completion of chemical sensitization.

Photothermographic materials are constantly being redesigned to meet ever-increasing performance, storage, and manufacturing demands raised by customers, regulators, and manufacturers. One of these demands is increased photospeed without a significant increase in fog ($D_{min}$) or a loss in $D_{max}$.

SUMMARY OF THE INVENTION

The present invention relates to our discovery that the use of certain tellurium compounds as chemical sensitizers provides photothermographic materials having increased photospeed without a significant increase in $D_{min}$.

The present invention provides the desired benefits with a photothermographic material comprising a support having thereon one or more layers comprising a binder and in reactive association:

a. a preformed silver halide, b. a non-photosensitive source of reducible silver ions, c. a reducing composition for the reducible silver ions, and d. a tellurium chemical sensitizer represented by the following Structure I or II:

$$Te(L)_m(X^1)_n \quad \text{I}$$

$$Pd(X^2)_2[Te(R')_2]_2 \quad \text{II}$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different.

In some Structure I embodiments, when m is 0 and n is 2 the compounds represented by Structure I can be further represented by Structure III,

III

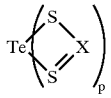

wherein X represents the same or different $COR_a$, $CSR_a$, $CN(R_a)(R_b)$, $CR_a$, $P(R_a)(R_b)$, or $P(OR_a)(OR_b)$ group, $R_a$ and $R_b$ are as defined above, and p is 2 or 4.

In other Structure I embodiments, when m is 0 and n is 2 the compounds represented by Structure I can be further represented by Structure III, wherein X represents the same or different $COR_a$, $CSR_a$, $CN(R_a)(R_b)$, $CR_a$, $P(R_a)(R_b)$, or $P(OR_a)(OR_b)$ group, $R_a$ and $R_b$ are as defined above, p is 2, and then X cannot be two identical $CN(R_a)(R_b)$ groups.

In Structure I, L represents the same or different neutral Lewis base ligands, such as ligands derived from one or more thiourea, substituted thiourea, pyridine, and substituted pyridines. In preferred embodiments, one or more ligands are derived from compounds represented by the following Structure IV, V, or VI:

IV

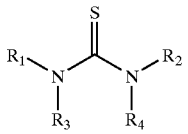

V

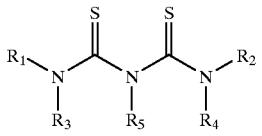

VI

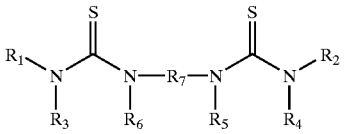

wherein:

in Structure IV, $R_1$, $R_2$, $R_3$ and $R_4$ are independently hydrogen, alkyl, cycloalkyl, alkenyl, alkynyl, aryl or heterocyclic groups, or $R_1$, and $R_2$ taken together, $R_3$ and $R_4$ taken together, $R_1$ and $R_3$ taken together or $R_2$ and $R_4$ taken together, can form a 5- to 7-membered heterocyclic ring, and in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

In another embodiment, the present invention provides a photothermographic material comprising a support having thereon one or more layers comprising a binder and in reactive association:

a. a photocatalyst, b. a non-photosensitive source of reducible silver ions, c. a reducing composition for the reducible silver ions, and d. a tellurium chemical sensitizer represented by the following Structure I or II:

$$Te(L)_m(X^1)_n \quad \text{I}$$

$$Pd(X^2)_2[Te(R')_2]_2 \quad \text{II}$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ arealkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, and m is 0, 1, 2, or 4, n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different, except than when m is 0 and n is 2 and $X^1$ cannot be two identical $S(C{=}S)N(R_a)(R_b)$, groups.

Still other embodiments include a photothermographic material comprising a support having thereon one or more layers comprising a binder and in reactive association:

a. a photocatalyst, b. a non-photosensitive source of reducible silver ions, c. a reducing composition for the reducible silver ions, d. a tellurium chemical sensitizer represented by the following Structure I or II:

$$Te(L)_m(X^1)_n \quad \text{I}$$

$$Pd(X^2)_2[Te(R')_2]_2 \quad \text{II}$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different, and e. additional chemical sensitization achieved by oxidative decomposition of a spectral sensitizing dye.

Further embodiments include a photothermographic material comprising a support having thereon one or more layers comprising a binder and in reactive association:

a. a photocatalyst, b. a non-photosensitive source of reducible silver ions, c. a reducing composition for the reducible silver ions, d. a tellurium chemical sensitizer represented by the following Structure I or II:

$$Te(L)_m(X^1)_n \quad \text{I}$$

$$Pd(X^2)_2[Te(R')_2]_2 \quad \text{II}$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)_2$, SeCN, TeCN, CN, $SR_a$, $OR_a$, $N_3$, alkyl, aryl, or $O(C{=}O)R_a$ groups, $R_a$ and $R_b$ are alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different, and e. a heteroaromatic mercapto compound or a heteroaromatic disulfide compound in an amount of at least 0.0001 mole per mole of total silver.

Additionally, a photothermographic material comprises a support having thereon one or more layers comprising a binder and in reactive association:

a. a photocatalyst, b. a non-photosensitive source of reducible silver ions, c. a reducing composition for the reducible silver ions, d. a tellurium chemical sensitizer represented by the following Structure I or II:

$$Te(L)_m(X^1)_n \quad \text{I}$$

$$Pd(X^2)_2[Te(R')_2]_2 \quad \text{II}$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different, and e. phthalazine or a phthalazine derivative.

Yet other embodiments include a photothermographic material comprising a support having thereon one or more layers comprising a binder and in reactive association:

a. a photocatalyst, b. a non-photosensitive source of reducible silver ions, c. a reducing composition for said reducible silver ions, d. a tellurium chemical sensitizer represented by the following Structure I or II:

$$Te(L)_m(X^1)_n \quad \text{I}$$

$$Pd(X^2)_2[Te(R')_2]_2 \quad \text{II}$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different, and e. a co-developer.

In still another embodiment, the present invention provides a photothermographic material comprising a support having thereon one or more layers comprising a binder and in reactive association:

a. a photocatalyst, b. a non-photosensitive source of reducible silver ions, c. a reducing composition for said reducible silver ions, d. a tellurium chemical sensitizer represented by the following Structure I or II:

$$Te(L)_m(X^1)_n \quad \text{I}$$

$$Pd(X^2)_2[Te(R')_2]_2 \quad \text{II}$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different, and e. additional chemical sensitization achieved by addition of a second chemical sensitizer that is represented by the following Structure IV, V, or VI:

IV

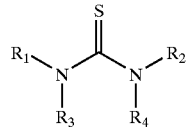

V

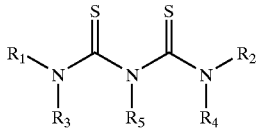

VI

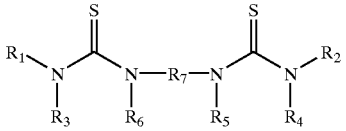

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

This invention also provides a photothermographic material comprising a transparent support having thereon one or more layers one on side thereof comprising a binder and in reactive association:

a. a photocatalyst, b. a non-photosensitive source of reducible silver ions, c. a reducing composition for the reducible silver ions, and d. a tellurium chemical sensitizer represented by the following Structure I or II:

$$Te(L)_m(X^1)_n \quad \text{I}$$

$$Pd(X^2)_2[Te(R')_2]_2 \quad \text{II}$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different, and on the opposite side of the transparent support, an antihalation layer comprising one or more antihalation dyes.

Further, a method of this invention for forming a visible image comprises:

A) imagewise exposing any of the photothermographic materials described above to electromagnetic radiation to form a latent image, and B) simultaneously or sequentially, heating the exposed photothermographic material to develop the latent image into a visible image.

In some embodiments of this invention to provide an image, any of the photothermographic materials described above has a transparent support and the imaging method of this invention further includes:

C) positioning the exposed and heat-developed photothermographic material with a visible image therein between a source of imaging radiation and an imageable material that is sensitive to the imaging radiation, and D) thereafter exposing the imageable material to the imaging radiation through the visible image in the exposed and heat-developed photothermographic material to provide a visible image in the imageable material.

In still another embodiment of this invention, a method for preparing a photothermographic emulsion comprises the following steps, in order:

A) providing a photothermographic emulsion comprising silver halide grains and a non-photosensitive source of reducible silver ions, and B) positioning one or more of the tellurium chemical sensitizers represented by Structures I or II noted above, on or around the silver halide grains.

Moreover, another method of preparing a photothermographic emulsion comprises:

A) providing silver halide grains,

B) providing a photothermographic emulsion of the silver halide grains and a non-photosensitive source of reducible silver ions, and C) during or anytime after step A, chemically sensitizing the silver halide grains with a tellurium chemical sensitizer represented by Structure I or II as noted above.

The speed increasing compounds described for use in the photothermographic materials of this invention have a number of useful properties. For example, they can easily be prepared in good yields as air stable solids and are resistant to hydrolysis. Moreover, they are soluble in a range of useful coating solvents. This allows them to be included easily in the imaging element formulations.

The speed increasing ability of the tellurium compounds described herein was not anticipated from the teaching in the prior art. Moreover, prior art chemical sensitizers have generally not produced speed enhancement while maintaining high $D_{max}$ and low $D_{min}$.

DETAILED DESCRIPTION OF THE INVENTION

The photothermographic materials of this invention can be used, for example, in conventional black-and-white photothermography, in electronically generated black-and-white hardcopy recording. They can be used in microfilm applications, in radiographic imaging (for example, digital medical imaging), and in industrial radiography. Furthermore, the absorbance of these photothermographic materials between 350 and 450 nm is desirably low (less than 0.5) to permit their use in graphic arts are (for example, imagesetting and phototypesetting), in the manufacture of printing plates, in contact printing, proofing, and duplicating ("duping"). The photothermographic materials are particularly useful for medical radiography to provide black-and-white images.

In the photothermographic materials of this invention, the components needed for imaging can be in one or more layers. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity (or reactive association) and preferably are in the same layer. "Catalytic proximity" or "reactive association" means that they are in the same or adjacent layers.

Various layers are usually disposed on the "backside" (non-emulsion side) of the materials, including antihalation layer(s), protective layers, antistatic layers, conducting layers, and transport enabling layers.

Various layers are also usually disposed on the "frontside" or emulsion side of the support, including protective topcoat layers, primer layers, interlayers, opacifying layers, antistatic layers, antihalation layers, acutance layers, auxiliary layers, and others readily apparent to one skilled in the art.

Definitions

As used herein:

In the descriptions of the photothermographic materials of the present invention, "a" or "an" component refers to "at least one" of that component. For example, the tellurium compounds described herein for chemical sensitization can be used individually or in mixtures.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Macmillan 1977, p. 374.

"Photothermographic material(s)" means a construction comprising at least one photothermographic emulsion layer or a photothermographic set of layers (wherein the silver halide and the source of reducible silver ions are in one layer and the other essential components or desirable additives are distributed, as desired, in an adjacent coating layer) and any supports, topcoat layers, image-receiving layers, blocking layers, antihalation layers, or subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer," "imaging layer," or "photothermographic emulsion layer," means a layer of a photothermographic material that contains the photosensitive silver halide and/or non-photosensitive source of reducible silver ions. It can also mean a layer of the photothermographic material that contains, in addition to the photosensitive silver halide and/or non-photosensitive source of reducible ions, additional essential components and/or desirable additives. These layers are usually on what is known as the "frontside" of the support.

"Ultraviolet region of the spectrum" refers to that region of the spectrum less than or equal to 410 nm, and preferably from about 100 nm to about 410 nm, although parts of these ranges may be visible to the human eye. More preferably, the ultraviolet region of the spectrum is the region of from about 190 to about 405 nm.

"Visible region of the spectrum" refers to that region of the spectrum of from about 400 nm to about 750 nm.

"Short wavelength visible region of the spectrum" refers to that region of the spectrum from about 400 nm to about 450 nm.

"Red region of the spectrum" refers to that region of the spectrum of from about 600 nm to about 750 nm.

"Infrared region of the spectrum" refers to that region of the spectrum of from about 750 nm to about 1400 nm.

"Non-photosensitive" means not intentionally light sensitive.

"Transparent" means capable of transmitting visible light or imaging radiation without appreciable scattering or absorption.

The sensitometric terms "photospeed" or "photographic speed"(also known as "sensitivity"), "contrast", $D_{min}$, and $D_{max}$ have conventional definitions known in the imaging arts.

As is well understood in this area, for the tellurium compounds defined herein, substitution is not only tolerated, but is often advisable and various substituents are anticipated on the compounds used in the present invention. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example, $CH_3$—$CH_2$—$CH_2$—O—$CH_2$— and $CH_3$—$CH_2$—$CH_2$—S—$CH_2$—), haloalkyl, nitroalkyl, carboxyalkyl, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide and others readily apparent to one skilled in the art. Mixtures of silver halides can also be used in any suitable proportion. Silver bromide and silver bromoiodide are more preferred, with the latter silver halide having up to 10 mol % silver iodide. Typical techniques for preparing and precipitating silver halide grains are described in *Research Disclosure,* 1978, item 17643.

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, and platelet morphologies, and may have epitaxial growth of crystals thereon. If desired, a mixture of these crystals may be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. Core-shell silver halide grains useful in photothermographic materials and methods of preparing these materials are described for example, in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example, U.S. Pat. No. 3,839,049 (Simons)]. Materials of this type are often referred to as "preformed soaps."

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, 1966 Chapter 2. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.) and U.S. Pat. No. 2,489,341 (Waller et al.)].

It is also effective to use an in situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), and JP Applications 13224/74, 42529/76 and 17216/75.

In some instances, it may be helpful to prepare the photosensitive silver halide grains in the presence of a hydroxytetraazaindene (such as 4-hydroxy-6-methyl-1,3,3,3a,7-tetraazaindene) or an N-heterocyclic compound comprising at least one mercapto group (such as 1-phenyl-5-mercaptotetrazole) to provide increased photospeed. Details of this procedure are provided in U.S. Pat. No. 6,413,710 (Shor et al.), that is incorporated herein by reference.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical and Spectral Sensitizers

The advantages of this invention are provided by chemically sensitizing the silver halide(s) with certain speed increasing tellurium compounds. Thus, these tellurium compounds can be used effectively as chemical sensitizers. They can be represented by the following Structure I or II:

$$Te(L)_m(X^1)_n \qquad \text{I}$$

$$Pd(X^2)_2[Te(R')_2]_2 \qquad \text{II}$$

In Structure I, $X^1$ represents a halo (such as chloro, bromo, or iodo), OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, $N_3$, alkyl (as defined below for $R_a$ and $R_b$), aryl (as defined below for Ar), or $O(C{=}O)R_a$ group wherein $R_a$ and $R_b$ are as defined below. Preferably, $X^1$ represents a halo (such as chloro or bromo), SCN, or $S(C{=}S)N(R_a)(R_b)$ group, and more preferably, it represents a halo group such as chloro or bromo. The multiple $X^1$ groups in a Structure I compound can be the same or different groups.

The "$R_a$ and $R_b$" groups used to define $X^1$ can be any suitable substituted or unsubstituted alkyl group having 1 to 20 carbon atoms (including all possible isomers, such as methyl, ethyl, isopropyl, t-butyl, octyl, decyl, trimethylsilylmethyl, and 3-trimethylsilyl-n-propyl), substituted or unsubstituted alkenyl group having 2 to 20 carbon atoms (including all possible isomers such as ethenyl, 1-propenyl, and 2-propenyl) or substituted or unsubstituted carbocycyl groups (such as cyclopentyl, cyclohexyl, or cycloheptyl), heterocyclyl groups (such as morpholinyl, piperidyl, and piperazyl), or aryl group (Ar) having 6 to 10 carbon atoms in the single- or fused-ring system (such as phenyl, 4-methylphenyl, anthryl, naphthyl, xylyl, mesityl, indenyl, 2,4,6-tri(t-butyl)phenyl, pentafluorophenyl, p-methoxyphenyl, 3,5-dimethylphenyl, p-tolyl, pyridyl, and 2-phenylethyl). In addition, when $X^1$ groups contain more than an $R_a$ and an $R_b$ group, these groups may be joined together to form a substituted or unsubstituted 5- to 7-membered heterocyclic ring. Preferably, $R_a$ and $R_b$ are a substituted or unsubstituted alkyl group having 1 to 8 carbon atoms. Unless otherwise noted, multiple $R_a$ and $R_b$ groups in a molecule can be the same or different groups.

L represents the same or different neutral Lewis base ligands, such as ligands derived from thiourea, substituted thiourea, pyridine, and substituted pyridines. Preferably, L is a ligand derived from thiourea or a substituted thiourea, and more preferably, it is a ligand derived from a substituted thiourea as defined below in Structure IV, V, or VI. Multiple L groups in the Structure I groups can be the same or different groups.

Also, in Structure I, m is an integer selected from the group of integers of 0, 1, 2, and 4, and n is an integer of 2 or 4. However, when m is 0 or 2, n is 2 or 4, and when m is 1 or 4, n is 2. Preferably, m is 2 and n is 2 or 4.

In Structure II, $X^2$ represents a halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, alkyl, (as defined for $R_a$ and $R_b$), aryl (as defined above for Ar), $N_3$, or $O_2CR_a$ group in which $R_a$ and $R_b$ are as defined above. Preferably, $X^2$ represents a halo, SCN, or SeCN group. More preferably, $X^2$ is a chloro, bromo, or SCN group. The multiple $X^2$ groups in the Structure II compounds can be the same or different groups.

In addition, R' represents a substituted or unsubstituted alkyl or aryl group that is defined as described above for $R_a$ and $R_b$. Preferably, R' is a substituted or unsubstituted alkyl group having from 1 to 10 carbon atoms. The multiple R' groups in the molecule can be the same or different.

In particular embodiments of the Structure I compounds, when m is 0 and n is 2 the compounds represented by Structure I can be further represented by Structure III,

III

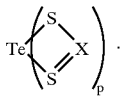

In Structure III, X represents the same or different $COR_a$, $CSR_a$, $CN(R_a)(R_b)$, $CR_a$, $P(R_a)(R_b)$ or $P(OR_a)(OR_b)$ group that is attached to the two sulfur atoms through the noted carbon or phosphorus atom in the groups. Preferably, X represents the same or different $COR_a$, $CSR_a$or $CN(R_a)(R_b)$, $P(R_a)(R_b)$ or $P(OR_a)(OR_b)$ group, and more preferably X is the same or different $CN(R_a)(R_b)$ group. Also in Structure III, p is 2 or 4, and preferably it is 2. Thus, when p is 2 (as noted below), there can be 2 of the same or 2 different X groups. When p is 4, there can be 4 of the same X groups, or 2, 3, or 4 different X groups in the molecule.

Unless otherwise noted, the multiple $R_a$ and $R_b$ groups in the Structure III compounds can be the same or different groups. However, in some embodiments, when p is 2, X cannot be two identical $CN(R_a)(R_b)$ groups.

In Structure I, preferred thiourea ligands are derived from compounds represented below by Structure IV, V, or VI:

IV

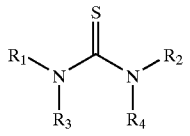

V

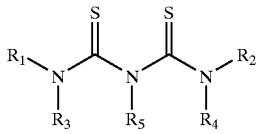

VI

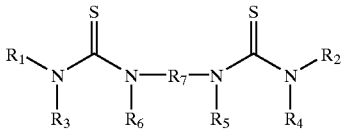

In Structure IV, $R_1$, $R_2$, $R_3$, and $R_4$ independently represent hydrogen, substituted or unsubstituted alkyl groups (including alkylenearyl groups such as benzyl), substituted or unsubstituted aryl groups (including arylenealkyl groups), substituted or unsubstituted cycloalkyl groups, substituted or unsubstituted alkenyl groups, substituted or unsubstituted alkynyl groups and heterocyclic groups.

Useful alkyl groups are branched or linear and can have from 1 to 20 carbon atoms (preferably having 1 to 5 carbon atoms), useful aryl groups can have from 6 to 14 carbon atoms in the carbocyclic ring, useful cycloalkyl groups can have from 5 to 14 carbon atoms in the central ring system, useful alkenyl and alkynyl groups can be branched or linear and have 2 to 20 carbon atoms, and useful heterocyclic groups can have 5 to 10 carbon, oxygen, sulfur and nitrogen atoms in the central ring system (they can also have fused rings).

These various monovalent groups can be further substituted with one or more groups including but not limited to, halo groups, alkoxycarbonyl groups, hydroxy groups, alkoxy groups, cyano groups, acyl groups, acyloxy groups, carbonyloxy ester groups, sulfonic acid ester groups, alkylthio groups, dialkylamino groups, carboxy groups, sulfo groups, phosphono groups, and any other group readily apparent to one skilled in the art. $R_1$, $R_2$, $R_3$, and $R_4$ can independently be alkyl groups.

Alternatively, $R_1$ and $R_3$ taken together, $R_2$ and $R_4$ taken together, $R_1$ and $R_2$ taken together, or $R_3$ and $R_4$ taken together, can form a substituted or unsubstituted 5- to 7-membered heterocyclic ring.

Where $R_1$ and $R_3$ are taken together or $R_2$ and $R_4$ are taken together, the heterocyclic rings can be saturated or unsaturated and can contain oxygen, nitrogen or sulfur atoms in addition to carbon atoms. Useful rings of this type include, but are not limited to, imidazole, pyrroline, pyrrolidine, thiohydantoin, pyridone, morpholine, piperazine and thiomorpholine rings. These rings can be substituted with one or more alkyl groups (having 1 to 5 carbon atoms), aryl groups (having 6 to 10 carbon atoms in the central ring system), cycloalkyl groups (having 5 to 10 carbon atoms in the central ring system), alkoxy groups, carbonyloxyester groups, halo groups, cyano groups, hydroxy groups, acyl groups, alkoxycarbonyl groups, sulfonic ester groups, alkylthio groups, carbonyl groups, carboxy groups, sulfo groups, phosphono groups, and other groups readily apparent to one skilled in the art.

Where $R_1$ and $R_2$ are taken together or $R_3$ and $R_4$ are taken together, the heterocyclic rings can be saturated or unsaturated and can contain oxygen, nitrogen or sulfur atoms in addition to carbon atoms. Useful rings of this type include, but are not limited to, 2-imidazolidinethione, 2-thioxo-1-imidazolidinone (thiohydantoin), 1,3-dihydro-2H-imidazole-2-thione, 1,3-dihydro-2H-benzimidazole-2-thione, tetrahydro-2,2-thioxo-5-pyrimidine, tetrahydro-1,3,5,-triazine-2(1H)-thione, dihydro-2-thioxo-4,6-(1H,3H)-pyrimidinedione, dihydro-1,3,5-triazine-2,4-(1H, 3H)-dione and hexahydrodiazepine-2-thione rings. These rings can be substituted with one or more alkyl groups (having 1 to 5 carbon atoms), aryl groups (having 6 to 10 carbon atoms in the central ring system), cycloalkyl groups (having 5 to 10 carbon atoms in the central ring system), carbonyloxyester groups, halo groups, cyano groups, hydroxy groups, acyl groups, alkoxycarbonyl groups, sulfonic ester groups, alkylthio groups, carbonyl groups, alkoxy groups, carboxy groups, sulfo groups, phosphono groups, and other groups readily apparent to one skilled in the art.

Preferably, $R_1$, $R_2$, $R_3$, and $R_4$ independently represent hydrogen, alkyl, alkenyl, alkynyl, aryl, and heterocyclic groups, more preferably hydrogen, alkyl, aryl, and alkenyl groups, and most preferably alkenyl groups. A preferred alkenyl group is an allyl group. A preferred alkyl group is a methyl group.

In Structure V noted above, $R_1$, $R_2$, $R_3$, $R_4$ and $R_5$ have the same definitions as noted above for $R_1$, $R_2$, $R_3$ and $R_4$ in Structure IV with the following differences:

$R_1$ and $R_3$ can be taken together, $R_2$ and $R_4$ can be taken together, $R_3$ and $R_5$ can be taken together and/or $R_4$ and $R_5$ can be taken together, to form substituted or unsubstituted 5- to 7-membered heterocyclic rings (as described above for Structure IV). When those heterocyclic rings are formed from $R_1$ and $R_3$ taken together or $R_2$ and $R_4$ taken together, they are as defined above for $R_1$ and $R_3$ taken together for Structure IV, but the resulting heterocyclic rings can have other substituents such as alkoxy groups, dialkylamino groups, and carboxy, sulfo, phosphono and other acidic groups. When those heterocyclic rings are formed from $R_3$ and $R_5$ taken together or $R_4$ and $R_5$ taken together, they can be substituted as described for $R_1$ and $R_3$ of Structure IV Useful rings of this type include, but are not limited to, 2-imidazolidinethione, 2-thioxo-1-imidazolidinone (thiohydantoin), 1,3-dihydro-2H-imidazole-2-thione, 1,3-dihydro-2H-benzimidazole-2-thione, tetrahydro-2, 2-thioxo-5-pyrimidine, tetrahydro-1,3,5,-triazine-2 (1H)-thione, dihydro-2-thioxo-4,6-(1H, 3H)-pyrimidinedione, dihydro-1,3,5-triazine-2,4-(1H, 3H)-dione and hexahydrodiazepine-2-thione rings.

For Structure V, the preferred groups for $R_1$–$R_5$ are hydrogen, alkyl, alkenyl, alkynyl, aryl, and heterocyclic groups, more preferably alkyl, aryl, and alkenyl groups, and more preferably alkenyl groups. A preferred alkenyl group is an allyl group.

Also in Structure V, most preferable alkyl groups are methyl and ethyl groups. Most preferable aryl groups are phenyl or tolyl groups. Most preferable cycloalkyl groups are cyclopentyl and cyclohexyl groups. Most preferably the alkenyl group is an allyl group. Most preferable heterocyclic groups are morpholino and piperazino groups.

In Structure VI noted above, $R_1$, $R_2$, $R_3$, $R_4$, $R_5$, and $R_6$ have the same definitions as noted above for $R_1$, $R_2$, $R_3$, $R_4$, and $R_5$ in Structure V described above. In addition, $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring as described above for the heterocyclic rings in Structure V.

$R_7$ is a divalent aliphatic or alicyclic linking group including but not limited to substituted or unsubstituted alkylene groups having 1 to 12 carbon atoms, substituted or unsubstituted cycloalkylene groups having 5 to 8 carbon atoms in the ring structure, substituted or unsubstituted arylene groups having 6 to 10 carbon atoms in the ring structure, substituted or unsubstituted divalent heterocyclyl groups having 5 to 10 carbon, nitrogen, oxygen, and sulfur atoms in the ring structure, or any combination of two or more of these divalent groups, or any two or more of these groups connected by ether, thioether, carbonyl, carbonamido, sulfoamido, amino, imido, thiocarbonyl, thioamido, sulfinyl, sulfonyl, or phosphinyl groups. Preferably, $R_7$ is a substituted or unsubstituted alkylene group having at least 2 carbon atoms.

Further details of these preferred thiourea ligands are provided in U.S. Pat. No. 6,368,779 (Lynch et al.), incorporated herein by reference. Most preferably, the thiourea compounds are substituted with the same aliphatic substituent.

Representative chemical sensitizers of Structure I, II, or III include, but are not limited to, the following compounds. It is to be understood that in coordination compounds, the exact chemical structures may not be known. The structures shown below are representative of the stoichiometry of the tellurium compounds.

I-1

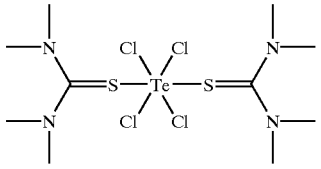

I-2

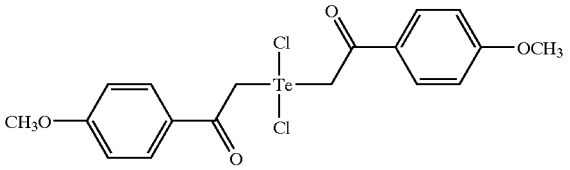

I-3

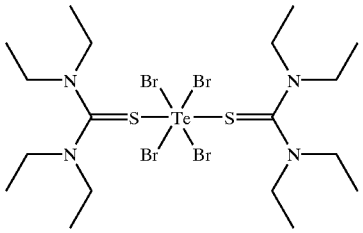

I-4

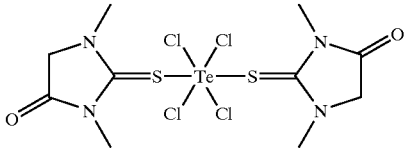

I-5

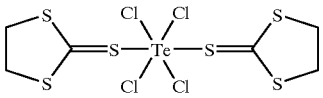

-continued
I-6
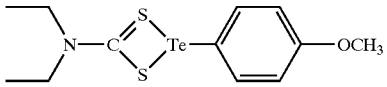
I-7
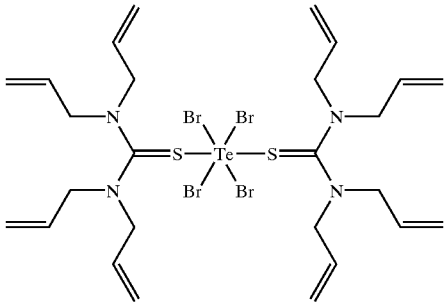
I-8
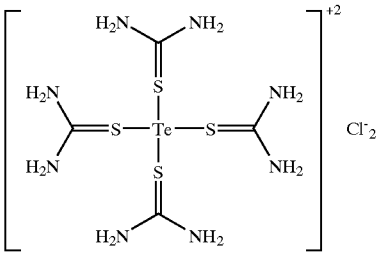
I-9
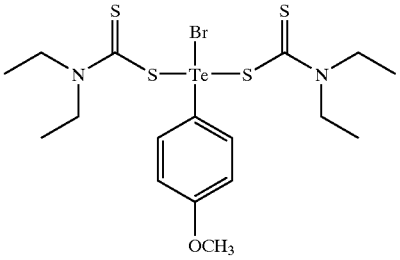
I-10
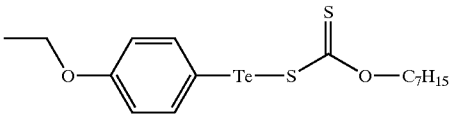
I-11
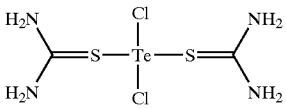
I-12
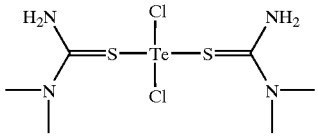
I-13
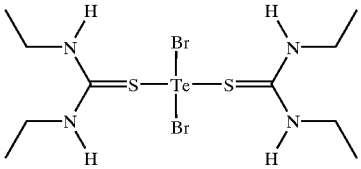
-continued
I-14
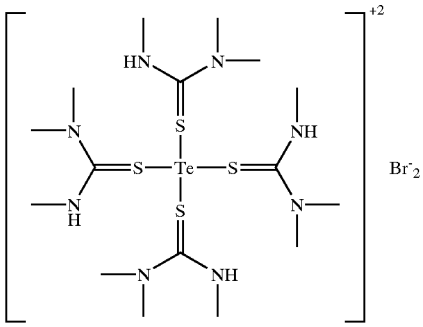
I-15
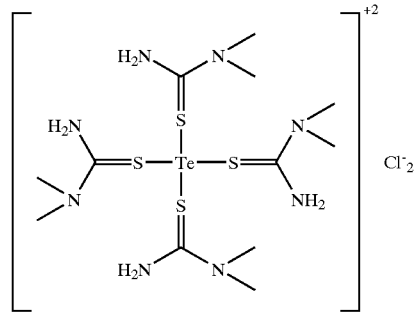
I-16
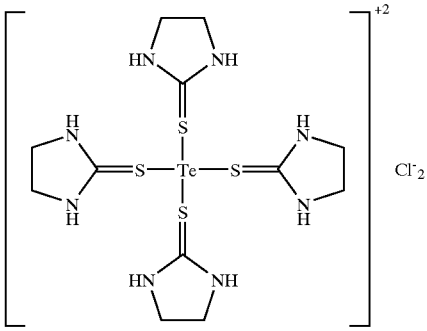
I-17 $Te(phenyl)_2[S(C{=}S)O\text{-}ethyl]_2$
I-18 $Te(pyridyl)_2Br_2$
I-19 Te(phenyl)Br
I-20 Te(p-tolyl)[S(C=S)O-butyl]
I-21 $Te(p\text{-}anisyl)[S(C{=}S)N(ethyl)_2]_2Br$
I-22
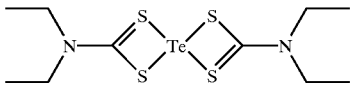
I-23
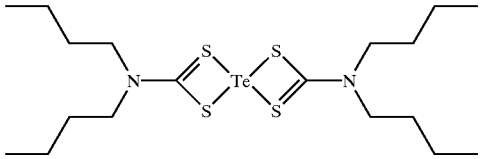

-continued

I-24

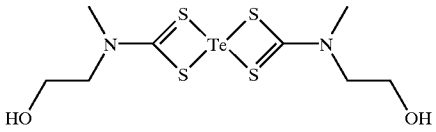

I-25

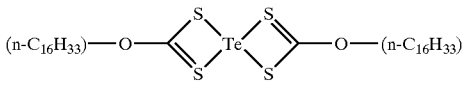

I-26

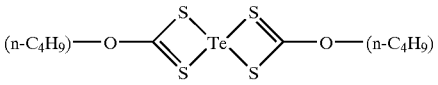

I-27

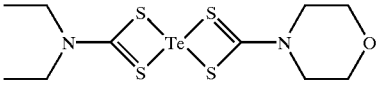

I-28

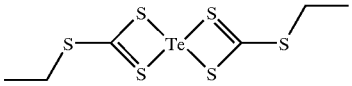

I-29

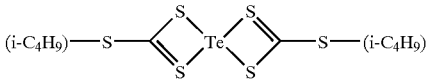

I-30

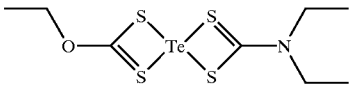

I-31

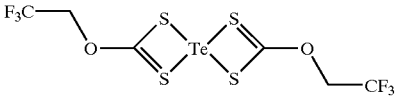

I-32

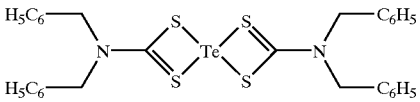

I-33

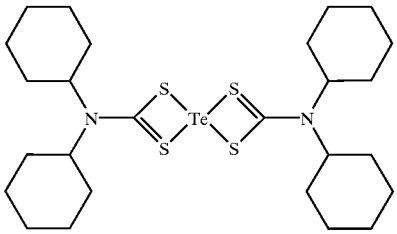

I-34

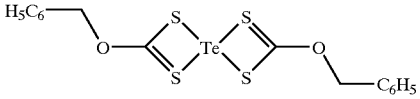

-continued

I-35

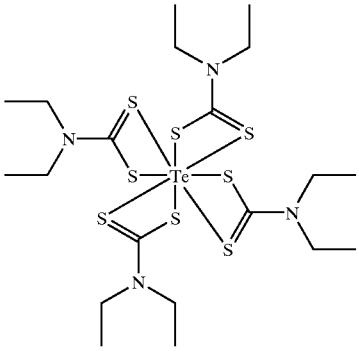

| | |
|---|---|
| $PdBr_2[Te(p\text{-anisyl})_2]_2$ | II-1 |
| $PdCl_2[Te(mesityl)_2]_2$ | II-2 |
| $Pd(SCN)_2\{Te[CH_2Si(CH_3)_3]_2\}_2$ | II-3 |
| $Te[S(P{=}S)(O\text{-ethyl})_2]_2$ | I-36 |
| $Te[S(P{=}S)(n\text{-butyl})_2]_2$ | I-37 |
| $Te[S(C{=}S)\text{-phenyl}]_2$ | I-38 |
| $Te]S(C{=}S)S\text{-i-propyl})_2$ | I-37 |
| $TeBr_4(pyridine)_2$ | I-40 |

The tellurium chemical sensitizers described herein by Structure I or II can be used individually or in mixtures. They can be present in one or more imaging layer(s) on the front side of the photothermographic material. Preferably, they are in every layer that contains the photocatalyst (for example, photosensitive silver halide). The total amount of such compounds in the material will generally vary depending upon the average size of silver halide grains. The total amount is generally at least $10^{-7}$ mole per mole of total silver, and preferably from about $10^{-5}$ to about $10^{-2}$ mole per mole of total silver for silver halide grains having an average size of from about 0.01 to about 2 $\mu$m. The upper limit can vary depending upon the compound used, the level of silver halide and the average grain size, and it would be readily determinable by one of ordinary skill in the art.

The tellurium chemical sensitizers useful in the present invention can be prepared using readily available starting materials and known procedures as described for example, in K. J. Irgolic "*The Organic Chemistry of Tellurium*", Gordon and Breach, NY, 1974, K. J. Irgolic, "*Houben Weyl Methods of Organic Chemistry*, Vol. E 12b, *Organotellurium Compounds*", D. Klamann, Ed., Georg Thieme Verlag, Stuttgart, Germany, 1990, *Synthetic Method of Organometallic and Inorganic Chemistry*. W. A. Herrmann and C. Zybill, Eds., George Thieme Verlag, NY, 1997: Vol. 4, Chapter 3: K. J. Irgolic, Tellurium and its Compounds, *The Chemistry of Organic Selenium and Tellurium Compounds*, Vol. 1 (1986) and Vol. 2 (1987), S. Patai and Z. Rappoport, Eds, Wiley, New York, H. J. Gysling, H. R. Luss, and D. L. Smith, *Inorg. Chem.,* 18, 2696(1979), H. J. Gysling, M. Lelental, M. G. Mason, and L. J. Gerenser, *J Photogr. Sci.,* 30, 55(1982), S. Husebye, *Phosphorus Sulfur,* 38, 271–280 (1988), S. Husebye, *Phosphorus, Sulfur Silicon Relat. Elem.,* 136, 137 & 138, 377–395(1998), I. Haiduc, R. B. King, and M. G. Newton, *Chem. Rev.,* 94, 301–326(1994), S. Husebye and K. W. Tornoos, *Acta Crystallog.*, C56, 1242(2000), and S. Husebye and K. Maartmann-Moe, *Acta Chem. Scand.,* 49, 834(1995).

Compound I-1, [$TeCl_4$(tetramethylthiourea)$_2$], was prepared as described in O. Foss and W. Johannessen, *Acta Chem. Scand.,* 15, 1939(1961).

Compounds of Structure II [$M(X^2)_2[Te(R')]_2$, where M=Pd or Pt, X=Cl, Br, or SCN, R'=alkyl or aryl] were prepared by reaction of the appropriate $K_2[MX_4]$ complex with 2 equivalents of the diorganotelluride as described in H. J. Gysling, H. R. Luss, and D. L. Smith, *Inorg. Chem.,* 18, 2696(1979). Dialkyl and diaryl tellurides were prepared by the standard procedures given in, for example, K. J. Irgolic "*The Organic Chemistry of Tellurium*", Gordon and Breach, NY, 1974. Tellurium complexes of the type $Te(S_2CN(R_{a2}))_4$ were prepared by the procedure reported in W. Mazurek and A. G. Moritz, *Inorg. Chim. Acta,* 154, 71(1988) and G. St. Nikolov, N. Jordanov, and I. Havezov, *J. Inorg. Nucl. Chem.,* 33, 1055(1971).

A representative synthesis of a Te complex of the type $Te(S_2X)_2$ [that is, $Te(S(C{=}S)NEt_2)_2$] is as follows:

$TeO_2$ (1.6 g, 10 mmol) was dissolved, with heating, in a solution of 4 ml concentrated hydrochloric acid and 7 ml of glacial acetic acid. After complete dissolution of the solid, the resulting pale yellow solution was cooled to −5° C. in an ice-salt bath and a solution of 10 g of $Na_2S_2O_3.5H_2O$ in 5 ml of water was slowly added with stirring (keeping the solution temperature below −5° C.). After complete addition of the $Na_2S_2O_3$ solution, 25 ml more of the HCl-glacial acetic acid solution were added. To the resulting solution (T=−5° C.), in an ice salt bath, a solution of $NaS_2CNEt_2.3H_2O$ (5.63 g, 25 mmol) in 150 ml water was added dropwise. After complete addition of the sodium diethyldithiocarbamate solution, the resulting reaction solution was diluted to 1 liter with water, stirred 15 minutes more at room temperature, and filtered. The isolated orange precipitate was washed well with water and air dried to afford 4.18 g. The crude product was recrystallized from 30 ml of hot toluene to give, on cooling for 12 hours at −10° C., a crop of burgundy-red needles [3.7 g (87%)], m.p.=160° C.

Analysis: Calcd (Found) for $C_{10}H_{20}N_2S_4Te$ (MW=424.14), C, 28.31(28.38), H, 4.75(4.51), N, 6.60 (6.59), S, 30.23 (29.94).

The tellurium chemical sensitizers described herein can be added at one or more times during the preparation of the photothermographic emulsion formulations. For example, they can be added before, during or after addition of pyridinium hydrobromide perbromide, calcium bromide, zinc bromide or similar addenda. In some embodiments, they are added before any toning agents (described below) are added to the formulation, or before any spectral sensitizing dyes (described below) are added. It would be readily determinable by routine experimentation as to the optimum time for adding a particular tellurium compound to achieve the maximum speed enhancement in the photothermographic emulsion.

Additional and conventional chemical sensitizers may be used in combination with the speed increasing tellurium compounds described above. Such compounds may contain sulfur or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915,371 (Lok et al.).

In one embodiment, a second chemical sensitizer is use in combination with the tellurium chemical sensitizers described herein. Preferred, additional chemical sensitizers are thiourea compound as represented by Structure IV, V, or VI described above. Most preferred additional chemical sensitizers are the tetra substituted thiourea compounds represented by Structure IV and those described in U.S. Pat. No. 6,368,779 (noted above).

As noted above, the photothermographic emulsions useful to make the imaging materials of this invention can be prepared by the following steps, in order:

A) providing a photothermographic emulsion comprising silver halide grains and a non-photosensitive source of reducible silver ions, and B) positioning one or more of the tellurium chemical sensitizers represented by Structure I or II described above on or around the silver halide grains.

Methods of preparation can also comprise:

A) providing silver halide grains,

B) providing a photothermographic emulsion of the silver halide grains and a non-photosensitive source of reducible silver ions, and C) during or anytime after step A, chemically sensitizing the silver halide grains with a tellurium chemical sensitizer represented by Structure I or II described above.

In some embodiments of this method, step C can follow step B. That is, chemical sensitization takes place after the formation of the non-photosensitive source of reducible silver in the presence of the preformed silver halide grains or the mixing of the non-photosensitive source of reducible silver in the presence of the preformed silver halide grains.

Alternatively, step C can be carried out between steps A and B. In this instance, the preformed silver halide grains are chemically sensitized immediately before they are mixed with the non-photosensitive source of reducible silver ions, or immediately before the non-photosensitive source of reducible silver ions is formed in their presence.

Still further, step C can be carried out during step A by chemically sensitizing preformed silver halide grains as they are mixed with the non-photosensitive source of reducible silver ions or as the non-photosensitive source of reducible silver ions is formed in their presence.

If the silver halide grains are further chemically sensitized with an organic sulfur-containing compound, step C can also include decomposing the sulfur-containing compound on or around the silver halide grains in an oxidizing environment. In some instances, the sulfur-containing compound is an organic sulfur-containing compound that is also known in the art as a spectral sensitizing dye. Such compounds are described for example, in U.S. Pat. No. 5,891,615 (Winslow et al.). Upon decomposition in an oxidizing environment, such compounds provide chemical sensitization instead of spectral sensitization.

In such embodiments, the method of preparing photothermographic emulsions will likely further comprise adding a second spectral sensitizing dye to the photothermographic emulsion to spectrally sensitize the silver halide grains.

In general, it may also be desirable to add spectral sensitizing dyes to enhance silver halide sensitivity to ultraviolet, visible and infrared light. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes, merocyanine dyes and complex merocyanine dyes are particularly useful. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.) and U.S. Pat. No. 5,541,054 (Miller et al.), U.S. Pat. No. 5,281,515 (Delprato et al.) and U.S. Pat. No. 5,314,795 (Helland et al.) are effective in the practice of the invention. All of these patents are incorporated herein by reference.

An appropriate amount of sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in photothermographic materials of this invention can be any compound that contains reducible silver (1+) ions. Preferably, it is a silver salt that is comparatively stable to light and forms a silver image when heated to 50° C. or higher in the presence of an exposed photocatalyst (such as silver halide) and a reducing composition.

Silver salts of organic acids, particularly silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver salts.

Preferred examples of the silver salts of aromatic carboxylic acid and other carboxylic acid group-containing compounds include, but are not limited to, silver benzoate, silver-substituted benzoates, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates having hydrocarbon chains incorporating ether or thioether linkages, or sterically hindered substitution in the α-(on a hydrocarbon group) or ortho-(on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described, for example, in U.S. Pat. No. 4,504,575 (Lee). Silver salts of sulfosuccinates are also useful as described for example, in EP-A-0 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-l-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,201,678 (Meixell)].

Furthermore, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described, for example, in U.S. Pat. No. 4,761,361 (Ozaki et al.) and U.S. Pat. No. 4,775,613 (Hirai et al.).

Silver complexes containing organophosphine ligands can also be used (for example, $Ag[P(R_8)_3]_nX^3$ ($R_8$=alkyl or aryl, n=1—4, $X^3$=$NO_3^-$, $BF_4^-$, $PF_6^-$, $SCN^-$, carboxylate, or $CF_3SO_3^-$), such as $Ag\{N(CH_2CH_2PPh_2)_3\}NO_3$ (as described in M. Khan et al., *Inorg. Chem.,* 32, 5800(1993)), $Ag(PPh_3)(O_3SCF_3)$ [as described in M. Bardji et al., Inorg. Chim. Acta, 304, 7(2000)], $[(Ph_3P)_2AgNO_3]_2$ [as described in P. G. Jones, *Acta Crystallogr.*, C49, 1148(1993)], $Ag\{P(Mesityl)_3\}_2PF_6$ [as described in E. C. Alyea et al., *Inorg. Chem.,* 21, 1369(1982)], $Ag(PPh_3)_2(O_2CCH_3)$ [as described in B. Femi-Onadeko, *Z. Kristallogr.,* 152, 159(1980)], $Ag(O_2CR_9)(PPh_3)_3$ wherein $R_9$=methyl, $CHCl_2$, $CH_2Cl$, $CCl_3$, phenyl, p-tolyl, o-tolyl, or m-tolyl [as described in C. Oldham et al., *J. Chem. Soc.*(Dalton Trans), 2068(1977), and $Ag(PPh_3)NO_3$ (as described in R. A. Stein et al., *Inorg. Chem.,* 16, 242(1977)]. "Ph" represents a phenyl group.

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films a silver carboxylate full soap, containing not more than about 15% of free fatty carboxylic acid and analyzing for about 22% silver, can be used. For opaque photothermographic materials, different amounts can be used.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

Non-photosensitive sources of reducible silver ions can also be provided as core-shell silver salts such as those described in commonly assigned U.S. Pat. No. 6,355,408 (Whitcomb et al.), that is incorporated herein by reference. These silver salts include a core comprised of one or more silver salts and a shell having one or more different silver salts.

Still another useful source of non-photosensitive reducible silver ions in the practice of this invention are the silver dimer compounds that comprise two different silver salts as described in U.S. Pat. No. 6,472,131 (Whitcomb), that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

As one skilled in the are would understand, the non-photosensitive source of reducible silver ions can include various mixtures of the various silver salt compounds described herein, in any desirable proportions.

The photocatalyst and the non-photosensitive source of reducible silver ions must be in catalytic proximity (that is, reactive association). "Catalytic proximity" or "reactive association" means that they should be in the same layer, or in adjacent layers. It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 $mol/m^2$ of dried photothermographic material, and preferably from about 0.01 to about 0.05 $mol/m^2$ of that material.

The total amount of silver (from all silver sources) in the photothermographic materials is generally at least 0.002 $mol/m^2$ and preferably from about 0.01 to about 0.05 $mol/m^2$.

Reducing Agents

The reducing agent (or reducing agent composition comprising two or more components) for the source of reducible silver ions can be any material, preferably an organic material, that can reduce silver (I) ion to metallic silver. Conventional photographic developers such as methyl gallate, hydroquinone, substituted hydroquinones, hindered phenols, amidoximes, azines, catechol, pyrogallol, ascorbic acid (and derivatives thereof, leuco dyes and other materials readily apparent to one skilled in the art can be used in this manner as described for example, in U.S. Pat. No. 6,020,117 (Bauer et al.).

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes described below.

Hindered phenol reducing agents are preferred (alone or in combination with one or more high contrast co-developing agents and co-developer contrast-enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl) methanes, bis(hydroxyphenyl)methanes, hindered phenols, and hindered naphthols each of which may be variously substituted.

Representative binaphthols include, but are not limited to, 1,1'-bi-2-naphthol, 1,1'-bi-4-methyl-2-naphthol, and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited to, 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1-bis(2-hydroxy-3,5-dimethylphenyl)-3,5,5-trimethylhexane (NONOX or PERMANAX WSO), 1,1-bis(3,5-di-t-butyl-4-hydroxyphenyl)methane, 2,2-bis(4-hydroxy-3-methylphenyl)propane, 4,4-ethylidene-bis(2-t-butyl-6-methylphenol), 2,2'-isobutylidene-bis(4,6-dimethylphenol) (LOWINOX 221B46), and 2,2-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems include amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid, such as 2,2'-bis(hydroxymethyl)-propionyl-β-phenyl hydrazide in combination with ascorbic acid, a combination of polyhydroxybenzene and hydroxylamine, a reductone and/or a hydrazine [for example, a combination of hydroquinone and bis(ethoxyethyl)hydroxylamine], piperidinohexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenylacetate and ethyl-α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamidophenol, and p-benzenesulfonamidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1 4-dihydropyridine), ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described for example, in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in U.S. Pat. No. 6,387,605 (Lynch et al.), incorporated herein by reference. Examples of these compounds include, but are not limited to, 2,5-dioxocyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference. Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene)cyanoacetates and their metal salts.

Various contrast enhancers can be used in some photothermographic materials with specific co-developers. Examples of useful contrast enhancers include, but are not limited to, hydroxyl amine, alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents noted above are incorporated herein by reference.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

For color imaging materials (for example, monochrome, dichrome, or full color images), one or more reducing agents can be used that can be oxidized directly or indirectly to form or release one or more dyes.

The dye-forming or releasing compound may be any colored, colorless, or lightly colored compound that can be oxidized to a colored form, or to release a preformed dye when heated, preferably to a temperature of from about 80° C. to about 250° C. for a duration of at least 1 second. When used with a dye- or image-receiving layer, the dye can diffuse through the imaging layers and interlayers into the image-receiving layer of the photothermographic material.

Leuco dyes or "blocked" leuco dyes are one class of dye-forming compounds (or "blocked" dye-forming compounds) that form and release a dye upon oxidation by silver ion to form a visible color image in the practice of the present invention. Leuco dyes are the reduced form of dyes that are generally colorless or very lightly colored in the visible region (optical density of less than 0.2). Thus, oxidation provides a color change that is from colorless to colored, an optical density increase of at least 0.2 units, or a substantial change in hue Representative classes of useful leuco dyes include, but are not limited to, chromogenic leuco dyes (such as indoaniline, indophenol, or azomethine dyes), imidazole leuco dyes such as 2-(3,5-di-t-butyl-4-hydroxyphenyl)-4,5-diphenylimidazole as described for example in U.S. Pat. No. 3,985,565 (Gabrielson et al.), dyes having an azine, diazine, oxazine, or thiazine nucleus such as those described for example in U.S. Pat. No. 4,563,415 (Brown et al.), U.S. Pat. No. 4,622,395 (Bellus et al.), U.S. Pat. No. 4,710,570 (Thien), and U.S. Pat. No. 4,782,010 (Mader et al.), and benzylidene leuco compounds as described for example in U.S. Pat. No. 4,932,792 (Grieve et al.), all incorporated herein by reference. Further details about the chromogenic leuco dyes noted above can be obtained from U.S. Pat. No. 5,491,059 (noted above, Column 13) and references noted therein.

Another useful class of leuco dyes includes what are known as "aldazine" and "ketazine" leuco dyes that are described for example in U.S. Pat. No. 4,587,211 (Ishida et al.) and U.S. Pat. No. 4,795,697 (Vogel et al.), both incorporated herein by reference.

Still another useful class of dye-releasing compounds includes those that release diffusible dyes upon oxidation. These are known as preformed dye release (PDR) or redox dye release (RDR) compounds. In such compounds, the reducing agents release a mobile preformed dye upon oxidation. Examples of such compounds are described in U.S. Pat. No. 4,981,775 (Swain), incorporated herein by reference.

Further, other useful image-forming compounds are those in which the mobility of a dye moiety changes as a result of an oxidation-reduction reaction with silver halide, or a nonphotosensitive silver salt at high temperature, as described for example in JP Kokai 165,054/84.

Still further, the reducing agent can be a compound that releases a conventional photographic dye forming color coupler or developer upon oxidation as is known in the photographic art.

The dyes that are formed or released can be the same in the same or different imaging layers. A difference of at least 60 nm in reflective maximum absorbance is preferred. More preferably, this difference is from about 80 to about 100 nm. Further details about the various dye absorbances are provided in U.S. Pat. No. 5,491,059 (noted above, Col. 14).

The total amount of one or more dye-forming or releasing compound that can be incorporated into the photothermographic materials of this invention is generally from about 0.5 to about 25 weight % of the total weight of each imaging layer in which they are located. Preferably, the amount in each imaging layer is from about 1 to about 10 weight %, based on the total dry layer weight. The useful relative proportions of the leuco dyes would be readily known to a skilled worker in the art.

Other Addenda

The photothermographic materials of the invention can also contain other additives such as shelf-life stabilizers, toners, antifoggants, contrast enhancers, development accelerators, acutance dyes, post-processing stabilizers or stabilizer precursors, and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae: Ar—S-M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings are also envisioned to be suitable. For example, hetreroaromatic mercapto compounds are described as supersensitizers for infrared photothermographic materials in EP-A-0 559 228. (Philip Jr. et al).

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

The photothermographic materials of the present invention can be further protected against the production of fog and can be stabilized against loss of sensitivity during storage. While not necessary for the practice of the invention, it may be advantageous to add mercury(II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum and gold salts as described in U.S. Pat. No. 2,566,263 (Trirelli) and U.S. Pat. No. 2,597,915 (Damshroder), and 2-(tribromomethylsulfonyl) quinoline compounds as described in U.S. Pat. No. 5,460,938 (Kirk et al.).

Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.) and U.S. Pat. No. 5,300,420 (Kenney et al.).

In addition, certain substituted-sulfonyl derivatives of benzotriazoles (for example, alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.).

Furthermore, specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), compounds having —$SO_2CBr_3$ groups as described, for example, in U.S. Pat. No. 5,594,143 (Kirk et al.) and U.S. Pat. No. 5,374,514 (Kirk et al.), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in EP-A-0 600,589 (Philip, Jr. et al.) and EP-A-0 600,586 (Philip, Jr. et al.), and tribromomethylketones as described, for example, in EP-A-0 600,587 (Oliff et al.).

Preferably, the photothermographic materials of this invention include one or more polyhalo antifoggants that include one or more polyhalo substituents including but not limited to, dichloro, dibromo, trichloro and tribromo groups. The antifoggants can be aliphatic, alicyclic or aromatic compounds, including aromatic heterocyclic and carbocyclic compounds.

Particularly useful antifoggants are polyhalo antifoggants, such as those having a $—SO_2C(X')_3$ group wherein X' represents the same or different halogen atoms.

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer. Toners are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of toners include but are not limited to phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaamminecobalt(3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides [such as (N,N-dimethylaminomethyl)phthalimide, and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole)], merocyanine dyes (such as 3-ethyl-5-[(3-ethyl-2-benzothiazolinylidene)-1-methyl-ethylidene]-2-thio-2,4-o-azolidinedione), phthalazine and derivatives thereof [such as those described in U.S. Pat. No. 6,146,822 (Asanuma et al.)], phthalazinone and phthalazinone derivatives, or metal salts or these derivatives (such as 4-(1-naphthyl)phthalazinone, 6-chlorophthalazinone, 5,7-dimethoxyphthalazinone, and 2,3-dihydro-1,4-phthalazinedione), a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate (III), rhodium bromide, rhodium nitrate, and potassium hexachlororhodate (III)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives (such as 3,6-dimercapto-1,4-diphenyl-1H, 4H-2,3a,5,6a-tetraazapentalene and 1,4-di-(o-chlorophenyl)-3,6-dimercapto-1H, 4H-2,3a,5,6a-tetraazapentalene).

Phthalazine and phthalazine derivatives [such as those described in U.S. Pat. No. 6,146,822 (noted above), incorporated herein by reference] are particularly useful toners.

Binders

The photocatalyst (such as photosensitive silver halide), the non-photosensitive source of reducible silver ions, the reducing agent composition, and any other additives used in the present invention are generally added to one or more binders that are either hydrophilic or hydrophobic. Thus, either aqueous or solvent-based formulations can be used to prepare the photothermographic materials of this invention. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and Pioloform BS-18 or Pioloform BL-16 (Wacker Chemical Company). Aqueous dispersions (or latices) of hydrophobic binders may also be used.

Examples of useful hydrophilic binders include, but are not limited to, gelatin and gelatin-like derivatives (hardened or unhardened), cellulosic materials such as hydroxymethyl cellulose, acrylamide/methacrylamide polymers, acrylic/methacrylic acid polymers, polyvinyl pyrrolidones, polyvinyl acetates, polyvinyl alcohols and polysaccharides (such as dextrans and starch ethers).

Hardeners for various binders may be present if desired. Useful hardeners are well known and include diisocyanate compounds as described for example, in EP-0 600 586B1 and vinyl sulfone compounds as described in EP-0 600 589B1.

Where the proportions and activities of the photothermographic materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The polymer binder(s) is used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Support materials may also be treated or annealed to reduce shrinkage and promote dimensional stability. Polyethylene terephthalate film is the most preferred support. Various support materials are described, for example, in *Research Disclosure*, August 1979, item 18431. A method of making dimensionally stable polyester films is described in *Research Disclosure*, September 1999, item 42536.

Opaque supports can also be used, such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Photothermographic Formulations

The formulation for the photothermographic emulsion layer(s) can be prepared by dissolving and dispersing the binder, the photocatalyst, the non-photosensitive source of reducible silver ions, the reducing composition, and optional addenda in an organic solvent, such as toluene, 2-butanone (methyl ethyl ketone), acetone, or tetrahydrofuran.

Alternatively, these components can be formulated with a hydrophilic binder in water or water-organic solvent mixtures to provide aqueous-based coating formulations.

Photothermographic materials of this invention can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads, including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-A-0 792 476 (Geisler et al.) describes various means of modifying the photothermographic materials to reduce what is known as the "woodgrain" effect, or uneven optical density. This effect can be reduced or eliminated by several means, including treatment of the support, adding matting agents to the topcoat, using acutance dyes in certain layers, or other procedures described in the noted publication.

The photothermographic materials of this invention can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The photothermographic materials can be constructed of one or more layers on a support. Single layer materials should contain the photocatalyst, the non-photosensitive source of reducible silver ions, the reducing composition, the binder, as well as optional materials such as toners, acutance dyes, coating aids and other adjuvants.

Two layer constructions comprising a single imaging layer coating containing all the ingredients and a surface protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another in photothermographic materials are also known, as described for example, in U.S. Pat. No. 5,891,610 (Bauer et al.), U.S. Pat. No. 5,804,365 (Bauer et al.) and U.S. Pat. No. 4,741,992 (Przezdziecki). Adhesion can also be promoted using specific polymeric adhesive materials as described for example, in U.S. Pat. No. 5,928,857 (Geisler et al.).

Layers to reduce emissions from the film may also be present, including the polymeric barrier layers described in U.S. Pat. No. 6,352,819 (Kenney et al), U.S. Pat. No. 6,352,820 (Bauer et al), and U.S. Pat. No. 6,420,102 (Bauer et al.), all incorporated herein by reference.

Photothermographic formulations described can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.) and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers, described above, may be used. Such formulations are described in U.S. Pat. No. 6,355,405 (Ludemann et al).

Mottle and other surface anomalies can be reduced in the materials of this invention by incorporation of a fluorinated polymer as described for example, in U.S. Pat. No. 5,532,121 (Yonkoski et al.) or by using particular drying techniques as described, for example, in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, a manufacturing method can also include forming on the opposing or backside of said polymeric support, one or more additional layers, including an antihalation layer, an antistatic layer, or a layer containing a matting agent (such as silica), or a combination of such layers. It is also contemplated that the photothermographic materials of this invention can include emulsion layers on both sides of the support.

In preferred embodiments, the photothermographic materials of this invention include a surface protective layer on the same side of the support as the one or more thermally-developable layers, an antihalation layer on the opposite side of the support, or both a surface protective layer and an antihalation layer on their respective sides of the support.

To promote image sharpness, photothermographic materials according to the present invention can contain one or more layers containing acutance and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials of this invention contain an antihalation coating on the support opposite to the side on which the emulsion and topcoat layers are coated.

Dyes particularly useful as antihalation and acutance dyes include dihydroperimidine squaraine dyes having the nucleus represented by the following general structure:

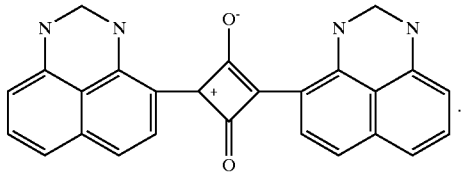

Details of such dyes having the dihydroperimidine squaraine nucleus and methods of their preparation can be found in U.S. Pat. No. 6,063,560 (Suzuki et al.) and U.S. Pat. No. 5,380,635 (Gomez et al.), both incorporated herein by reference. These dyes can also be used as acutance dyes in frontside layers of the materials of this invention. One particularly useful dihydroperimidine squaraine dye is cyclobutenediylium, 1,3-bis[2,3-dihydro-2,2-bis[[1-oxohexyl)oxy]methyl]-1H-perimidin-4-yl]-2,4-dihydroxy-, bis(inner salt).

Dyes particularly useful as antihalation dyes in a backside layer of the photothermographic material also include indolenine cyanine dyes having the nucleus represented by the following general structure:

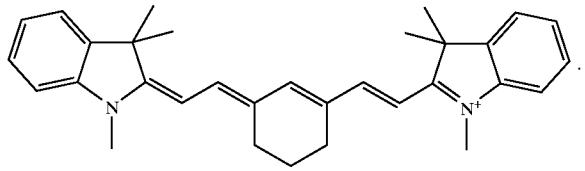

Details of such antihalation dyes having the indolenine cyanine nucleus and methods of their preparation can be found in EP-A-0 342 810 (Leichter), incorporated herein by reference. One particularly useful cyanine dye, compound (6) described therein, is 3H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate.

It is also useful in the present invention to employ compositions including acutance or antihalation dyes that will decolorize or bleach with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), EP-A-0 911 693 (Sakurada et al.).

Additional heat-bleachable antihalation compositions include hexaarylbiimidazoles (HABI's) used in combination with certain oxonol dyes as described for example in copending U.S. Ser. No. 09/875,772 (filed Jun. 6, 2001 by Goswami, Ramsden, Zielinski, Baird, Weinstein, Helber, and Lynch), or other dyes described for example in copending U.S. Ser. No. 09/944,573 (filed Aug. 31, 2001 by Ramsden and Baird), both incorporated herein by reference.

Imaging/Development

Generally, the materials of this invention are sensitive to radiation in the range of from about 300 to about 850 nm. Imaging can be achieved by exposing the photothermographic materials to a suitable source of radiation to which they are sensitive (typically some type of radiation or electronic signal), including ultraviolet light, visible light, near infrared radiation, and infrared radiation to provide a latent image.

While the imaging materials of the present invention can be imaged in any suitable manner consistent with the type of material using any suitable imaging source (typically some type of radiation or electronic signal), the following discussion will be directed to the preferred imaging means. Generally, the materials are sensitive to radiation in the range of from about 300 to about 850 nm.

Imaging can be achieved by exposing the photothermographic materials to a suitable source of radiation to which they are sensitive, including ultraviolet light, visible light, near infrared radiation and infrared radiation to provide a latent image. Suitable exposure means are well known and include laser diodes that emit radiation in the desired region, photodiodes and others described in the art, including *Research Disclosure*, Vol. 389, September 1996, item 38957, (such as sunlight, xenon lamps and fluorescent lamps). Particularly useful exposure means uses laser diodes, including laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example, at about 150° C. for up to 10 seconds), followed by thermal diffusion at a lower temperature (for example, at about 80° C.) in the presence of a transfer solvent.

Use as a Photomask

The photothermographic materials of the present invention are sufficiently transmissive in the range of from about 350 to about 450 nm in non-imaged areas to allow their use in a process where there is a subsequent exposure of an ultraviolet or short wavelength visible radiation sensitive imageable medium. For example, imaging the photothermographic material and subsequent development affords a visible image. The beat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This process is particularly useful where the imageable medium comprises a printing plate and the photothermographic material serves as an imagesetting film.

The present invention also provides a method for the formation of a visible image (usually a black-and-white image) by first exposing to electromagnetic radiation and thereafter heating the inventive photothermographic material. In one embodiment, the present invention provides a method comprising:

A) imagewise exposing any of the photothermographic materials of this invention to electromagnetic radiation to which the photocatalyst (for example, a photosensitive silver halide) of the material is sensitive, to form a latent image, and B) simultaneously or sequentially, heating the exposed photothermographic material to develop the latent image into a visible image.

The photothermographic material may be exposed in step A using any source of source of radiation to which they are sensitive, including ultraviolet light, visible light, near infrared radiation, infrared radiation, or any other radiation source readily apparent to one skilled in the art.

This visible image can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the exposed and heat-developed photothermographic material. Thus, in some other embodiments wherein the photothermographic material comprises a transparent support, the image-forming method further comprises:

C) positioning the exposed and heat-developed photothermographic material with the visible image therein between a source of imaging radiation and an imageable material that is sensitive to the imaging radiation, and D) thereafter exposing the imageable material to the imaging radiation through the visible image in the exposed and heat-developed photothermographic material to provide an image in the imageable material.

The following examples are provided to illustrate the practice of this invention, and are not intended to be limiting in any manner. The examples provide exemplary synthetic procedures and preparatory procedures using the tellurium speed increasing compounds within the scope of the present invention.

Materials and Methods for the Examples

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID™ A-21 is an acrylic copolymer available from Rohm and Haas (Philadelphia, Pa.).

BUTVAR® B-79 is a polyvinyl butyral resin available from Solutia, Inc. (St. Louis, Mo.).

CAB 171-15S is a cellulose acetate butyrate resin available from Eastman Chemical Co (Kingsport, Tenn.).

DESMODUR N3300 is an aliphatic hexamethylene diisocyanate available from Bayer Chemicals (Pittsburgh, Pa.).

PERMANAX WSO (or NONOX) is 1,1-bis(2-hydroxy-3,5-dimethylphenyl)-3,5,5-trimethylhexane [CAS RN=7292-14-0] and is available from St-Jean PhotoChemicals, Inc. (Quebec, Canada).

MEK is methyl ethyl ketone (or 2-butanone).

Dye A is

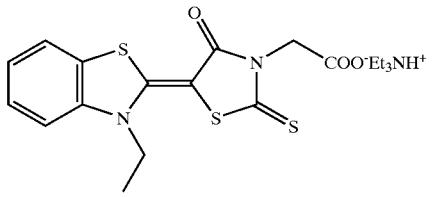

Sensitizing Dye A is

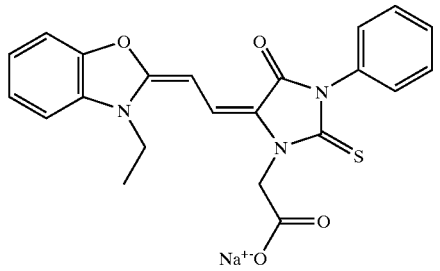

-continued

Sensitizing Dye B is

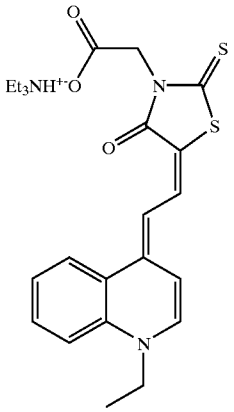

Sensitizing Dye C is

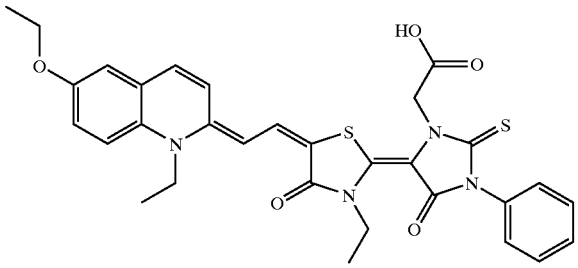

Compound HC-1 is described in U.S. Pat. No. 5,545,515 (noted above) and has the following structure:

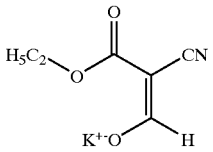

Vinyl Sulfone-1 (VS-1) is described in EP-0 600 589B1 and has the following structure:

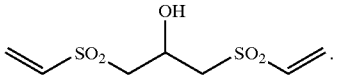

Antifoggant A is 2-(tribromomethylsulfonyl)quinoline and has the following structure:

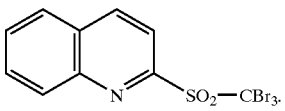

Antifoggant B is:

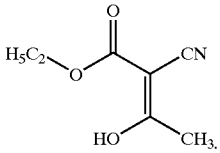

Backcoat Dye BC-1 is cyclobutenediylium, 1,3-bis[2,3-dihydro-2,2-bis [[1-oxohexyl)oxy]methyl]-1H-perimidin-4-yl]-2,4-dihydroxy-, bis(inner salt). It is believed to have the structure shown below.

BC-1

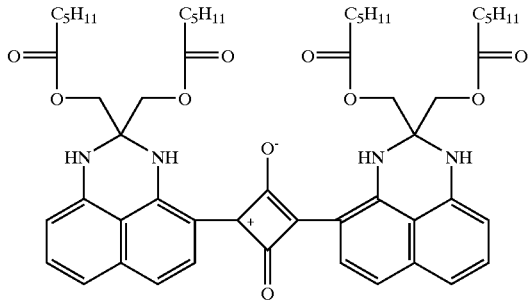

Comparative Compound C-1 can be represented by the structure:

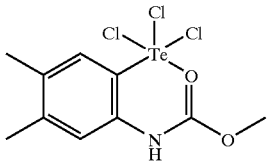

Comparative Compound C-2 can be represented by the structure.

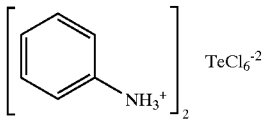

Comparative Compound C-3 is diphenylditelluride and can be represented by the structure:

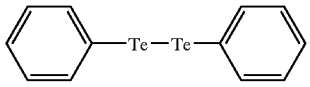

Comparative Compound C-4 is benzo[b]tellurophene-2-carboxylic acid and can be represented by the structure:

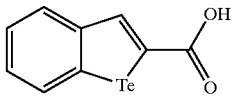

Comparative Compound C-5 is telluroxanthone and can be represented by the structure:

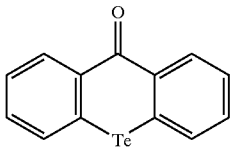

EXAMPLE 1

A preformed iridium-copper-doped core-shell silver halide-silver carboxylate "soap" dispersion was prepared as described in U.S. Pat. No. 5,939,249 (noted above), incorporated herein by reference. The silver halide grains were 0.05 μm. A photothermographic emulsion was prepared from this dispersion in a manner similar to that described in U.S. Pat. No. 6,083,681 (noted above), also incorporated herein by reference, but using the materials and amounts shown below.

| Photothermographic Emulsion Formulation: | |
|---|---|
| To 169 g of this silver soap dispersion at 28.8% solids was added: | |
| Pyridinium hydrobromide perbromide | 0.20 g in 1.58 g of methanol |
| Calcium bromide | 0.15 g in 1.19 g of methanol |
| Chemical sensitizer Compound I-1 | $4.4 \times 10^{-5}$ mol in 5 g of methanol |
| Dye premix | (see formulation below) |
| BUTVAR ® B-79 polyvinyl butyral | 20 g |
| Antifoggant A | 0.6 g in 10 g of MEK |
| DESMODUR N3300 | 0.75 g in 0.75 g of MEK |
| Phthalazine | 1.05 g in 3 g of MEK |
| Tetrachlorophthalic acid | 0.35 g in 2 g of MEK |
| 4-Methylphthalic acid | 0.45 g in 2.5 g of MEK |
| PERMANAX WSO | 10.6 g |
| MEK | To make 250 g total batch size. |
| Dye premix Formulation: | |
| Sensitizing Dye A | 0.02 g |
| Chlorobenzoyl benzoic acid | 1.42 g |
| Methanol | 5.0 g |
| Protective Topcoat Formulation | |
| A protective topcoat for the photothermographic emulsion layer was prepared as follows: | |
| ACRYLOID ™ A-21 polymer | 2.0 g |
| CAB 171-15S cellulose acetate butyrate | 51.24 g |
| MEK | 639 g |
| VS-1 | 1.45 g (80% solids) |
| Antifoggant B | 0.4 g |
| Benzotriazole | 5.5 g |

The photothermographic emulsion and topcoat formulations were coated under safelight conditions onto a 7 mil (178 μm) blue-tinted polyethylene terephthalate support optionally provided with a backside coating containing Backcoat Dye BC-1 in CAB 171-15S resin using a conventional dual-knife coating machine. Coating and drying were carried out as described in U.S. Pat. No. 6,083,681 (noted above), incorporated herein by reference.

Samples of the resulting photothermographic materials were imagewise exposed for $10^{-3}$ seconds using an EG&G Flash sensitometer with a P-31 filter and developed using a heated roll processor for 15 seconds at 124° C.

Densitometry measurements were made on a custom built computer-scanned densitometer using a filter appropriate to the sensitivity of the photothermographic material and are believed to be comparable to measurements from commercially available densitometers. $D_{min}$ is the density of the non-exposed areas after development and it is the average of the eight lowest density values. "SP-2" is Log1/E+4 corresponding to the density value of 1.00 above $D_{min}$ where E is the exposure in ergs/cm$^2$. "SP-3" is Log1/E+4 corresponding to the density value of 2.90 above $D_{min}$ where E is the exposure in ergs/cm$^2$. Average Contrast-1 ("AC-1") is the absolute value of the slope of the line joining the density points of 0.60 and 2.00 above $D_{min}$. "Con-D" is the absolute value of the slope of the line joining the density points at 1.00 and 3.00 above $D_{min}$.

The sensitometric result of imaging the resulting photothermographic material is shown in the following TABLE I. The changes in $D_{min}$ and SP-2 are relative to a control photothermographic material having the same composition and structure but from which chemical sensitizer Compound I-1 had been omitted.

TABLE I

| Tellurium Chemical Sensitizer | $\Delta D_{min}$ | ΔSP-2 |
|---|---|---|
| I-1 | +0.140 | +0.707 |

EXAMPLE 2

Several photothermographic materials similar to that described in Example 1 were prepared using 0.05 μm iridium-copper doped core-shell silver halide grain emulsions or 0.12 μm silver halide grain emulsions and chemical sensitizer Compound I-1. The 1X amount of chemical sensitizer represents $4.4 \times 10^{-5}$ mole per 250 g batch of emulsion.

The photothermographic materials were coated, imaged and developed as described in Example 1. The resulting sensitometric data are recorded in TABLE II below. The changes in $D_{min}$ and SP-2 (labeled $\Delta D_{min}$ and ΔSP-2) are relative to a control photothermographic material from which chemical sensitizer compound I-1 had been omitted, but were otherwise prepared identically to the inventive materials.

TABLE II

| Tellurium Chemical Sensitizer | AgX Grain Size (μm) | Amount | $\Delta D_{min}$ | ΔSP-2 |
|---|---|---|---|---|
| I-1 | 0.05 | ⅓X | 0.016 | +0.20 |
| I-1 | 0.05 | 2X | 0.047 | +0.39 |
| I-1 | 0.12 | 1X | 0.064 | +0.36 |

EXAMPLE 3

This example demonstrates the effect of the tellurium chemical sensitizers in photothermographic materials prepared using iridium-doped core-shell silver halide grains as described in U.S. Pat. No. 5,434,043 (noted above). The silver halide grains were sensitized using a red sensitizing dye and high contrast agent HC-1. All of the materials provided a "Con-D" greater than 10.

Photothermographic Emulsion Formulation:

To 182 g of a silver soap dispersion containing 46 g of preformed silver carboxylate were added:

| | |
|---|---|
| MEK | 8 g |
| Pyridinium hydrobromide perbromide | 0.2544 g |
| Zinc bromide | 0.288 g |
| Chemical sensitizer | (see TABLE III below) |
| Dye premix | (see below for formulation) |
| BUTVAR ® B-79 polyvinyl butyral | 31.8 g |
| Antifoggant A | 1.6 g |
| DESMODUR N3300 | 0.49 g |
| Phthalazine | 1.2 g |
| Tetrachlorophthalic acid | 0.27 g |
| 4-Methylphthalic acid | 0.60 g |
| PERMANAX WSO | 12.0 g |
| HC-1 high contrast agent | 0.215 g |

Dye premix Formulation:

| | |
|---|---|
| Sensitizing Dye B or C | ($2.368 \times 10^{-5}$ mol) |
| Chlorobenzoyl benzoic acid | 2.32 g |
| Methanol | 9.82 g |

Protective topcoat Formulation

A protective topcoat for the photothermographic emulsion layer was prepared as follows (20 g topcoat):

| | |
|---|---|
| ACRYLOID ™ A-21 polymer | 0.052 g |
| CAB 171-15S cellulose acetate butyrate | 1.34 g |
| MEK | 16.95 g |
| VS-1 | 0.079 g |

2-Mercaptobenzoxazole ("MBO") was added to some of the silver "soap" dispersions as a "mercapto additive" (0.0926 mmol).

The photothermographic emulsion and topcoat formulations were coated under safelight conditions onto a 4 mil (102 $\mu$m) polyethylene terephthalate support provided with an antihalation backcoat comprising a dye that has absorbance >1.0 at the wavelength of exposure (670 nm), using a conventional dual knife coating machine. Coating and drying were carried out as described in Example 1.

The resulting photothermographic materials were imagewise exposed using a scanning laser sensitometer having a 670 nm laser diode. The materials were then developed using a heated roller processor for 13 seconds at 118° C. TABLE III below contains the resulting sensitometric data for use of various tellurium chemical sensitizers according to the present invention. The changes in $D_{min}$ and SP3 are relative to a control photothermographic material from which the chemical sensitizer was omitted, but otherwise prepared identically to the invention materials.

TABLE III

| Tellurium Chemical Sensitizer | Average Grain Size ($\mu$m) | Amount (g) | Sensitizing Dye | Mercapto Additive | ΔDmin | ΔSP-3 |
|---|---|---|---|---|---|---|
| I-1 | 0.065 | 0.012 | B | None | +0.012 | +0.82 |
| I-1 | 0.065 | 0.012 | C | None | +3.1 | — |
| I-1 | 0.065 | 0.012 | C | MBO | +0.17 | +0.98 |

EXAMPLE 4

This example demonstrates the use of speed increasing compounds (chemical sensitizers) in green sensitive, high contrast photothermographic materials. A preformed non-core-shell silver halide, silver carboxylate soap was prepared as described in U.S. Pat. No. 5,382,504 (noted above). The average silver halide grain size was 0.12 $\mu$m. The photothermographic emulsion was prepared from the dispersion in a manner similar to that described in U.S. Pat. No. 6,083,681 (noted above) but using the materials and amounts shown below.

Photothermographic Emulsion Formulation:

To 188 g of this silver soap dispersion at 24.5% solids was added:

| | |
|---|---|
| Pyridinium hydrobromide perbromide | 0.20 g in 1.58 g of methanol |
| Calcium bromide | 0.15 g in 1.19 g of methanol |
| Chemical Sensitizer I-1 | (0.0441 mmol in 5.0 g of methanol) |
| Dye premix | (see below for formulation) |
| BUTVAR ® B-79 polyvinyl butyral | 20 g |
| Antifoggant A | 0.6 g in 10.0 g of MEK |
| PERMANAX WSO | 10.6 g |
| DESMODUR N3300 | 0.63 g in 1.5 g of MEK |
| Tetrachlorophthalic acid | 0.35 g in 2.0 g of MEK |
| Phthalazine | 1.00 g in 5.0 g of MEK |
| 4-Methylphthalic acid | 0.45 g in 0.5 g of methanol and 3.5 g of MEK |

Dye premix formulation:

| | |
|---|---|
| Sensitizing dye A | 0.0475 mmol |
| Chlorobenzoyl benzoic acid | 1.42 g |
| Methanol | 5.0 g |

Protective topcoat Formulation

A protective topcoat for the photothermographic emulsion layer was prepared as follows

| | |
|---|---|
| ACRYLOID ™ A-21 polymer | 0.58 g |
| CAB 171-15S cellulose acetate butyrate | 14.9 g |
| MEK | 184 g |
| VS-1 | 0.3 g |
| Benzotriazole | 1.6 g |
| Antifoggant B | 0.12 g |
| High contrast additive HC-1 | 0.05 g |

The photothermographic and topcoat formulations were coated, imaged, and developed as described in Example 1. The resulting photothermographic materials were imagewise exposed for $10^{-3}$ seconds and developed using a heated roll processor for 15 seconds at 124° C. The materials were shown to have a contrast (AC-1) greater than 6 and the other sensitometric results are shown in TABLE IV below for the use of Compound I-1 according to the present invention. The changes in $D_{min}$ and speed are relative to a control photothermographic material from which the chemical sensitizer had been omitted, but otherwise prepared identically to the invention materials.

TABLE IV

| Tellurium Chemical Sensitizer | Amount (mmol) | $\Delta D_{min}$ | ΔSP-2 |
|---|---|---|---|
| I-1 | 0.0441 | 0.041 | 0.563 |

EXAMPLE 5

This example demonstrates the use of a combination of tellurium speed increasing compounds (chemical sensitizers) and sulfur chemical sensitizing compounds (Dye A) described in U.S. Pat. No. 5,891,615 (noted above) to provide enhanced photospeed. Photothermographic materials were prepared as described in Example 4 except that they contained preformed 0.05 μm iridium-copper-doped core-shell silver halide grains prepared as described in U.S. Pat. No. 5,939,249 (noted above). Samples were prepared with and without high-contrast agent HC-1 in the topcoat. A solution of 0.02 g of Dye A in 5.0 g of methanol was optionally added before the addition of pyridinium hydrobromide perbromide.

The photothermographic materials were imagewise exposed and heat developed. The sensitometric results are shown below in TABLE V. The changes in $D_{min}$ and SP-2 are relative to an identically prepared control photothermographic material containing no chemical sensitizers. All samples incorporating HC-1 had an Average Contrast (AC-1) greater than 8.

TABLE V

| Chemical Sensitizer | Amount I-1 (mmol) | HC-1 Added | $\Delta D_{min}$ | ΔSP-2 |
|---|---|---|---|---|
| I-1 | 0.0027 | None | 0.008 | 0.010 |
| Dye A | None | None | −0.003 | 0.349 |
| I-1 + Dye A | 0.0027 | None | 0.004 | 0.444 |
| I-1 | 0.0027 | Yes | 0.005 | −0.039 |
| Dye A | None | Yes | 0.000 | 0.371 |
| I-1 + Dye A | 0.0027 | Yes | 0.002 | 0.498 |

EXAMPLE 6

This example demonstrates the use of a combination of tellurium speed increasing compounds (chemical sensitizers) and tetrasubstituted thiourea chemical sensitizing compounds described in U.S. Ser. No. 09/667,748 (noted above) to provide enhanced photospeed. Photothermographic materials were prepared as described in Example 4 except that they contained preformed 0.05 μm iridium-copper-doped core-shell silver halide grains prepared as described in U.S. Pat. No. 5,939,249 (noted above). All samples were prepared with high-contrast agent HC-1 in the topcoat. A solution of 0.01 g of tetraallylthiourea in 5.0 g of methanol was optionally added after the addition of calcium bromide.

The photothermographic materials were imagewise exposed and heat developed. The sensitometric results are shown below in TABLE VI. The changes in $D_{min}$ and SP-2 are relative to an identically prepared control photothermographic material containing no chemical sensitizers. All samples incorporating HC-1 had an Average Contrast (AC 1) greater than 8.

TABLE VI

| Chemical Sensitizer | Amount I-1 (mmol) | HC-1 Added | $\Delta D_{min}$ | ΔSP-2 |
|---|---|---|---|---|
| I-1 | 0.0027 | Yes | −0.001 | 0.025 |
| Tetra-allylthiourea | None | Yes | 0.044 | 0.877 |
| I-1 + Tetra-allylthiourea | 0.0027 | Yes | 0.072 | 1.214 |
| I-1 + Tetra-allylthiourea | 0.0018 | Yes | 0.055 | 0.986 |

EXAMPLE 7

This example demonstrates the use of tellurium compounds (chemical sensitizers) to provide enhanced photospeed. Photothermographic materials were prepared containing preformed 0.065 μm iridium-doped core-shell silver halide grains prepared as described in U.S. Pat. No. 5,434,043 (noted above). The silver halide grains were sensitized using sensitizing dye C. All of the materials incorporated high contrast agent HC-1 and contained MBO as a mercapto additive. All of the materials provided a "Con-D" greater than 10.

The photothermographic materials were coated, imaged, and heat developed as described in Example 3. The sensitometric results are shown below in TABLE VII. The changes in $D_{min}$ and Speed-3 are relative to an identically prepared control photothermographic material containing no chemical sensitizers. All samples exhibited a Con-D greater than 10.

TABLE VII

| Tellurium Chemical Sensitizer | Amount (mmol) | $\Delta D_{min}$ | ΔSP-3 |
|---|---|---|---|
| I-1 | 0.0262 | 0.016 | 0.758 |
| I-2 | 0.0256 | 0.003 | 0.062 |
| I-22 | 0.0238 | 0.022 | 0.792 |
| I-23 | 0.0258 | 0.007 | 0.249 |
| I-24 | 0.000132 | 0.140 | 0.558 |
| I-25 | 0.00089 | 0.13 | 0.473 |
| I-26* | 0.0054 | 0.085 | 0.338 |
| I-35* | 0.0262 | 0.016 | 0.291 |
| II-1 | 0.0265 | 0.041 | 0.463 |
| II-2 | 0.0131 | 0.244 | 0.179 |
| II-3 | 0.0027 | 0.074 | 0.135 |

*Samples incorporating sensitizers I-26 and I-35 used the indicated amount with Dye B as the spectral sensitizer.

COMPARATIVE EXAMPLES

Photothermographic materials were prepared as described in Example 3 except that Comparative Compounds C1–C5 were evaluated as chemical sensitizers in the photothermographic emulsion layers. The materials were imagewise exposed, heat-developed, and evaluated for certain sensitometric properties as described in Example 3. TABLE VIII below lists the amounts of each compound used as a chemical sensitizer and the resulting sensitometric properties. It can be seen that tellurium compounds not having structures I or II are not as effective in increasing speed while maintaining low $D_{min}$

TABLE VIII

| Tellurium Additive | Amount (mol) | $\Delta D_{min}$ | ΔSP-3 |
|---|---|---|---|
| C-1 | 0.0407 | 0.001 | 0.070 |
| C-2 | 0.0412 | −0.003 | 0.070 |
| C-3 | 0.0262 | 0.005 | 0.063 |
| C-4 | 0.0263 | 0.008 | 0 |
| C-5 | 0.0262 | 0.006 | 0 |

The invention has been described in detail with particular reference to certain preferred embodiments thereof, but it will be understood that variations and modifications can be effected within the spirit and scope of the invention.

We claim:

1. A photothermographic material comprising a support having thereon one or more layers comprising a binder and in reactive association:

a. a preformed photosensitive silver halide, b. a non-photosensitive source of reducible silver ions, c. a reducing composition for said reducible silver ions, and d. a tellurium chemical sensitizer represented by the following Structure I or II:

$$Te(L)_m(X^1)_n \quad (I)$$

$$Pd(X^2)_2[Te(R')_2]_2 \quad (II)$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different.

2. The photothermographic material of claim 1 wherein said tellurium chemical sensitizer is present in said material in an amount of at least $1\times10^{-7}$ mole per mole of total silver and total silver present in said material is at least 0.002 mol/$m^2$.

3. The photothermographic material of claim 2 wherein said tellurium chemical sensitizer is present in said material in an amount of from about $1\times10^{-5}$ to about 0.01 mole per mole of total silver.

4. The photothermographic material of claim 1 wherein L is derived from thiourea, a substituted thiourea, pyridine, or a substituted pyridine.

5. The photothermographic material of claim 1 wherein said chemical sensitizer is represented by Structure I and L is the same or different thiourea ligand derived from a compound represented by the following Structure IV, V, or VI:

(IV)

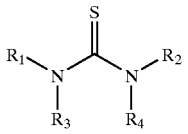

(V)

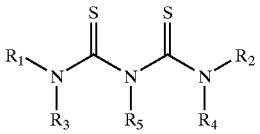

(VI)

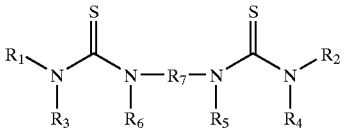

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

6. The photothermographic material of claim 1 wherein $X^1$ is a halo, SCN, or $S(C{=}S)N(R_a)(R_b)$ group.

7. The photothermographic material of claim 6 wherein $X^1$ is chloro or bromo.

8. The photothermographic material of claim 1 wherein said chemical sensitizer is represented by Structure I, m is 2, and n is 4.

9. The photothermographic material of claim 1 wherein said tellurium chemical sensitizer is represented by Structure III:

(III)

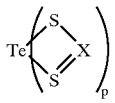

wherein X represents the same or different $COR_a$, $CSR_a$, $CN(R_a)(R_b)$, $CR_a$, $P(R_a)(R_b)$, or $P(OR_a)(OR_b)_2$ group, $R_a$ and $R_b$ are a substituted or unsubstituted alkyl group.

10. The photothermographic material of claim 9 wherein X is the same or different $CN(R_a)(R_b)$ group and p is 2.

11. The photothermographic material of claim 1 wherein said tellurium chemical sensitizer is represented by Structure II wherein $X^2$ is a halo, SCN, or SeCN group.

12. The photothermographic material of claim 11 wherein R' is a substituted or unsubstituted alkyl group having from 1 to 10 carbon atoms.

13. The photothermographic material of claim 1 wherein said tellurium chemical sensitizer is selected from the following group of compounds:

(I-1)

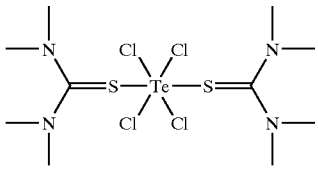

(I-2)

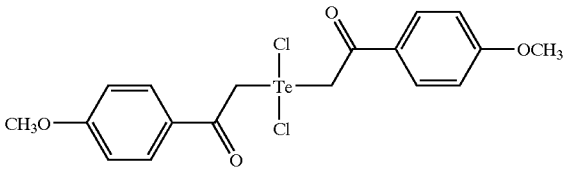

(I-3)

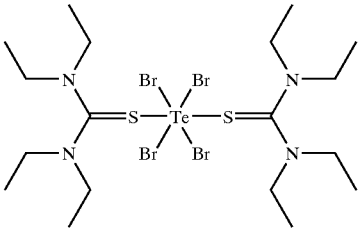

-continued
(I-4)
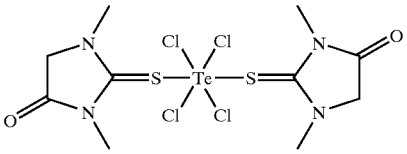
(I-5)
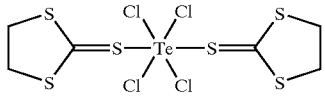
(I-6)
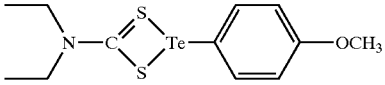
(I-7)
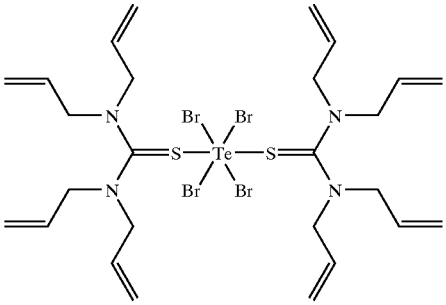
(I-8)
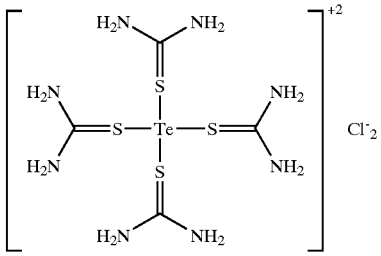
(I-9)
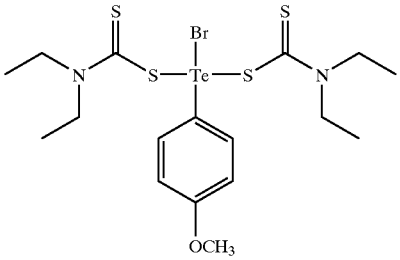
(I-10)
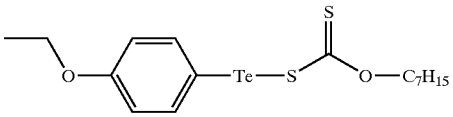
(I-11)
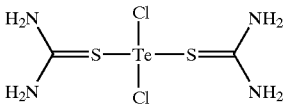
(I-12)
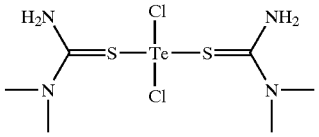
-continued
(I-13)
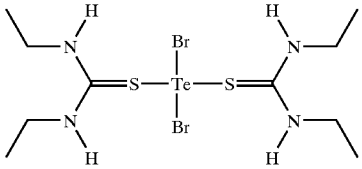
(I-14)
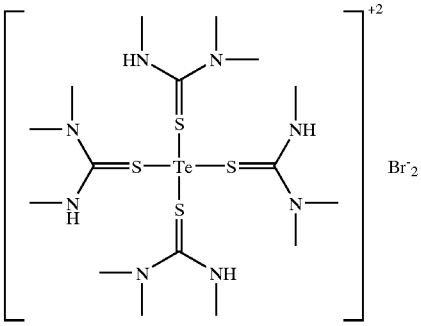
(I-15)
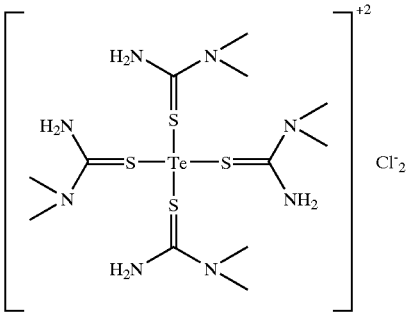
(I-16)
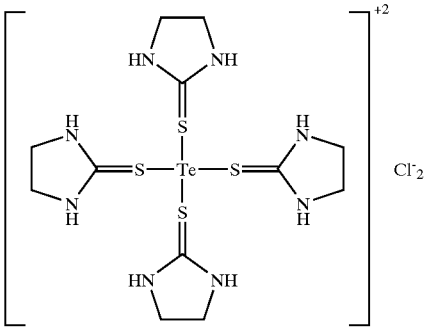
Te(phenyl)$_2$[S(C═S)O-ethyl]$_2$ (I-17)
Te(pyridyl)$_2$Br$_2$ (I-18)
Te(phenyl)Br (I-19)
Te(p-tolyl)[S(C═S)O-butyl] (I-20)
Te(p-anisyl)[S(C═S)N(ethyl)$_2$]$_2$Br (I-21)
(I-22)
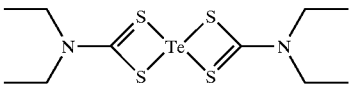

-continued (I-23)

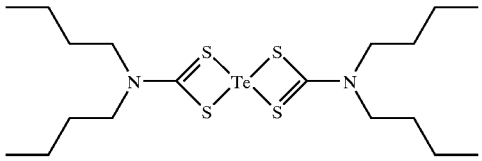

(I-24)

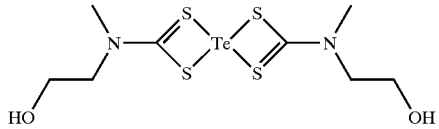

(I-25)

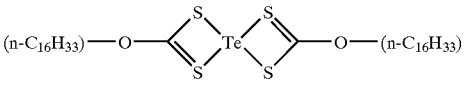

(I-26)

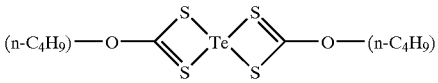

(I-27)

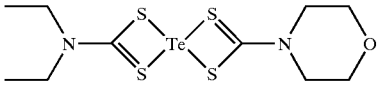

(I-28)

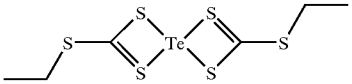

(I-29)

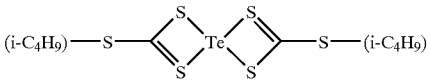

(I-30)

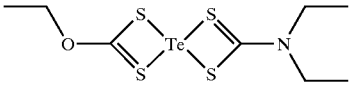

(I-31)

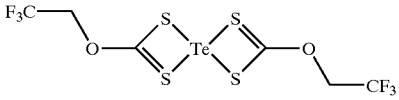

(I-32)

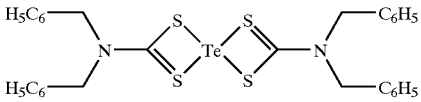

(I-33)

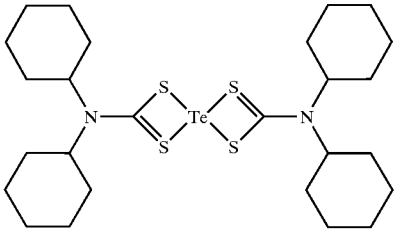

(I-34)

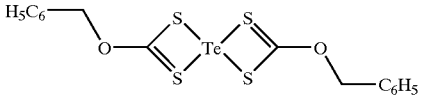

-continued (I-35)

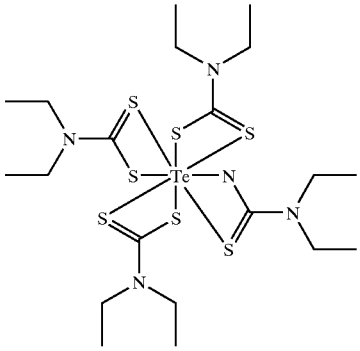

| | |
|---|---|
| $PdBr_2[Te(p\text{-anisyl})_2]_2$ | (II-1) |
| $PdCl_2[Te(mesityl)_2]_2$ | (II-2) |
| $Pd(SCN)_2\{Te[CH_2Si(CH_3)_3]_2\}_2$ | (II-3) |
| $Te[S(P{=}S)(O\text{-ethyl})_2]_2$ | (I-36) |
| $Te[S(P{=}S)(n\text{-butyl})_2]_2$ | (I-37) |
| $Te[S(C{=}S)\text{-phenyl}]_2$ | (I-38) |
| $Te]S(C{=}S)S\text{-i-propyl})_2$ | (I-39) |
| $TeBr_4(pyridine)_2$ | (I-40). |

14. The photothermographic material of claim 1 wherein said photocatalyst is a silver bromide, silver iodobromide, or a mixture of silver halides.

15. The photothermographic material of claim 1 wherein said binder is a hydrophobic binder.

16. The photothermographic material of claim 1 wherein said non-photosensitive source of reducible silver ions is a silver salt of a fatty acid having from 10 to 30 carbon atoms, or a mixture of said silver salts.

17. The photothermographic material of claim 1 further including a co-developer.

18. The photothermographic material of claim 17 wherein said co-developer is selected from the group consisting of trityl hydrazides, formyl phenyl hydrazides, 3-heteroaromatic-substituted acrylonitriles, 2-substituted malondialdehydes, substituted propenitriles, 4-substituted isoxazoles, 2,5-dioxocyclopentane carboxaldehydes, 5-(hydroxymethylene)-1,3-dialkylbarbituric acids, 2-(ethoxymethylene)-1H-indene-1,3(2H)-diones, and 2-substituted malondialdehyde compounds.

19. The photothermographic material of claim 18 further including a contrast enhancing agent.

20. The photothermographic material of claim 19 wherein said contrast enhancing agent is selected from the group consisting of hydroxylamines, alkanolamines, ammonium phthalamate compounds, hydroxamic acids, N-acylhydrazines, and hydrogen atom donor compounds.

21. The photothermographic material of claim 1 further comprising a heteroaromatic mercapto compound in an amount of at least 0.0001 mole per mole of total silver.

22. The photothermographic material of claim 21 wherein said heteroaromatic mercapto compound is 2-mercaptobenzimidazole, 2-mercapto-5-methylbenzimidazole, 2-mercaptobenzothiazole, 2-mercaptobenzoxazole, or a mixture of two or more of these compounds.

23. The photothermographic material of claim 1 further comprising a second chemical sensitizer that is represented by the following Structure IV, V, or VI:

(IV)

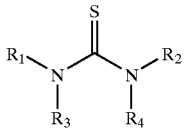

(V)

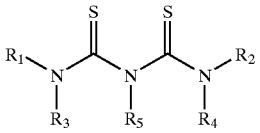

(VI)

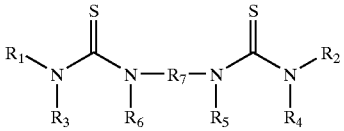

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

24. A photothermographic material comprising a transparent support having on one side thereof, one or more photothermographic emulsion layers comprising:

a. one or more preformed silver halides present in an amount of from about 0.005 to about 0.5 mole per mole of a non-photosensitive source of reducible silver ions, b. a non-photosensitive source of reducible silver ions that comprises one or more silver carboxylates of fatty acids having from 10 to 30 carbon atoms, said one or more silver carboxylates being present in an amount of from about 10 to about 50 weight % of the total dry weight of said emulsion layer(s), c. one or more hindered phenol reducing agents, d. one or more hydrophobic binders, e. a heteroaromatic mercapto compound, and f. one or more tellurium chemical sensitizers that are represented by the following Structure I or II:

$$Te(L)_m(X^1)_n \quad (I)$$

$$Pd(X^2)_2[Te(R')_2]_2 \quad (II)$$

wherein $X^1$ and $X^2$ independently represent the same or different chloro, bromo, SCN, $S(C{=}S)OR_a$, $S(C{=}S)SR_a$, or $S(C{=}S)N(R_a)(R_b)$ groups, the multiple $R_a$, $R_b$, and R'groups are the same or different alkyl groups, the multiple L groups are the same or different ligands derived from a thiourea as represented in Structure IV, V, or VI below, m is 2, n is 4, (IV)

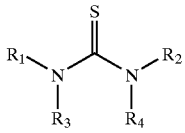

(V)

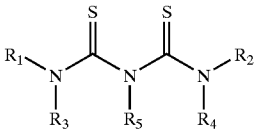

(VI)

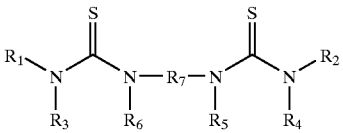

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group, said tellurium chemical sensitizer represented by Structure I or II being present in said material in an amount of from about $1\times10^{-5}$ to about 0.01 mole per mole of total silver.

25. The photothermographic material of claim 24 further comprising a dihydroperimidine squaraine dye having a nucleus represented by the following structure:

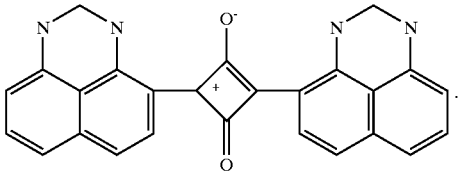

26. The photothermographic material of claim 24 wherein said dihydroperimidine squaraine dye is cyclobutenediylium, 1,3-bis[2,3-dihydro-2,2-bis[[1-oxohexyl)oxy]methyl]-1H-perimidin-4-yl]-2,4-dihydroxy-, bis(inner salt) that is present as an antihalation or acutance dye.

27. The photothermographic material of claim 24 further comprising a backside antihalation layer comprising an indolenine cyanine antihalation dye having a nucleus represented by the following structure:

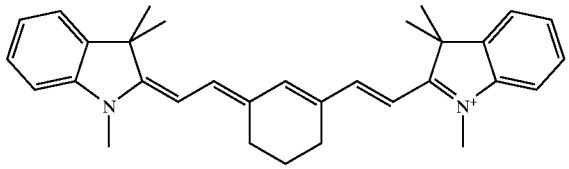

28. A method for forming a visible image comprising:

A) imagewise exposing the photothermographic material of claim 1 to electromagnetic radiation to form a latent image, and B) simultaneously or sequentially, heating said exposed photothermographic material to develop said latent image into a visible image.

29. The method of claim 28 wherein said photothermographic material is imagewise exposed using visible, near-infrared or infrared radiation.

30. The method of claim 28 wherein said photothermographic material support is transparent, and said method further comprises:

C) positioning said exposed and heat-developed photothermographic material with a visible image therein between a source of imaging radiation and an imageable material that is sensitive to said imaging radiation, and D) thereafter exposing said imageable material to said imaging radiation through said visible image in said exposed and heat-developed photothermographic material to provide a visible image in said imageable material.

31. The method of claim 30 wherein said imageable material is a photopolymer, a diazo material, a photoresist, or a photosensitive printing plate.

32. A method for preparing a photothermographic emulsion comprising the following steps, in order:

A) providing a photothermographic emulsion comprising silver halide grains and a non-photosensitive source of reducible silver ions, and B) positioning one or more of the tellurium chemical sensitizers represented by Structure I or II shown below on or around said silver halide grains, $$Te(L)_m(X^1)_n \quad (I)$$

$$Pd(X^2)_2[Te(R')_2]_2 \quad (II)$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different.

33. A method of preparing a photothermographic emulsion comprising:

A) providing silver halide grains,

B) providing a photothermographic emulsion of said silver halide grains and a non-photosensitive source of reducible silver ions, and C) during or anytime after step A, chemically sensitizing said silver halide grains with a tellurium chemical sensitizer represented by Structure I or II shown below $$Te(L)_m(X^1)_n \quad (I)$$

$$Pd(X^2)_2[Te(R')_2]_2 \quad (II)$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, $N_3$, alkyl, aryl, or $O(C{=})R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different.

34. The method of claim 33 wherein step C follows step B.

35. The method of claim 33 wherein step C is carried out between steps A and B.

36. The method of claim 33 wherein said silver halide grains are further chemically sensitized with an organic sulfur-containing compound and step C also includes decomposing said sulfur-containing compound on or around said silver halide grains in an oxidizing environment.

37. The method of claim 33 wherein said organic sulfur-containing compound is a spectral sensitizing dye.

38. The method of claim 37 further comprising adding a second spectral sensitizing dye to said photothermographic emulsion to spectrally sensitize said photosensitive silver halide grains.

39. The method of claim 33 wherein said silver halide grains are chemically sensitized using a second chemical sensitizer that is represented by the following Structure IV, V, or VI:

(IV)

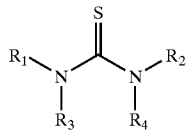

(V)

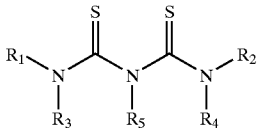

(VI)

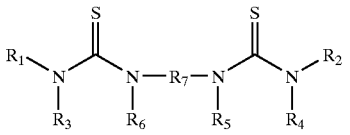

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

40. A photothermographic material comprising a support having thereon one or more layers comprising a binder and in reactive association:

a. a photocatalyst, b. a non-photosensitive source of reducible silver ions, c. a reducing composition for said reducible silver ions, and d. a tellurium chemical sensitizer represented by the following Structure I or II:

$$Te(L)_m(X^1)_n \quad (I)$$

$$Pd(X^2)_2[Te(R')_2]_2 \quad (II)$$

wherein $X^1$ and $X^2$ independently represent halo, OCN, SCN, $S(C{=}S)N(R_a)(R_b)$, $S(CS)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, and m is 0, 1, 2, or 4, n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different, except than when m is 0 and n is 2, $X^1$ cannot be two identical $S(C{=}S)N(R_a)(R_b)$ groups.

41. A photothermographic material comprising a support having thereon one or more layers comprising a binder and in reactive association:

a. a photocatalyst, b. a non-photosensitive source of reducible silver ions, c. a reducing composition for said reducible silver ions, d. a tellurium chemical sensitizer represented by the following Structure I or II:

$$Te(L)_m(X^1)_n \quad (I)$$

$$Pd(X^2)_2[Te(R')_2]_2 \quad (II)$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)_2$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different, and e. additional chemical sensitization achieved by oxidative decomposition of a spectral sensitizing dye.

42. A photothermographic material comprising a support having thereon one or more layers comprising a binder and in reactive association:

a. a photocatalyst, b. a non-photosensitive source of reducible silver ions, c. a reducing composition for said reducible silver ions, d. a tellurium chemical sensitizer represented by the following Structure I or II:

$$Te(L)_m(X^1)_n \quad (I)$$

$$Pd(X^2)_2[Te(R')_2]_2 \quad (II)$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6-or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different, and e. a heteroaromatic mercapto compound or a heteroaromatic disulfide compound in an amount of at least 0.0001 mole per mole of total silver.

43. A photothermographic material comprising a support having thereon one or more layers comprising a binder and in reactive association:

a. a photocatalyst, b. a non-photosensitive source of reducible silver ions, c. a reducing composition for said reducible silver ions, d. a tellurium chemical sensitizer represented by the following Structure I or II:

$$Te(L)_m(X^1)_n \quad (I)$$

$$Pd(X^2)_2[Te(R')_2]_2 \quad (II)$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different, and e. phthalazine or a phthalazine derivative.

44. A photothermographic material comprising a transparent support having thereon one or more layers one on side thereof comprising a binder and in reactive association:

a. a photocatalyst, b. a non-photosensitive source of reducible silver ions, c. a reducing composition for said reducible silver ions, and d. a tellurium chemical sensitizer represented by the following Structure I or II:

$$Te(L)_m(X^1)_n \quad (I)$$

$$Pd(X^2)_2[Te(R')_2]_2 \quad (II)$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)_2$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different, and on the opposite side of said transparent support, an antihalation layer comprising one or more antihalation dyes.

45. The photothermographic material of claim 44 wherein said antihalation layer comprises a heat-bleachable antihalation composition.

46. A method for forming a visible image comprising:

A) imagewise exposing the photothermographic material of claim 44 to electromagnetic radiation to form a latent image, and B) simultaneously or sequentially, heating said exposed photothermographic material to develop said latent image into a visible image.

47. A photothermographic material comprising a support having thereon one or more layers comprising a binder and in reactive association:

a. a photocatalyst, b. a non-photosensitive source of reducible silver ions, c. a reducing composition for said reducible silver ions, d. a tellurium chemical sensitizer represented by the following Structure I or II:

$$Te(L)_m(X^1)_n \quad (I)$$

$$Pd(X^2)_2[Te(R')_2]_2 \quad (II)$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)_2$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$, $X^2$, L, $R_a$, $R_b$, or R' groups in the molecule can be the same or different, and e. a co-developer.

48. The photothermographic material of claim 47 wherein said co-developer is selected from the group consisting of trityl hydrazides, formyl phenyl hydrazides, 3-heteroaromatic-substituted acrylonitriles, 2-substituted malondialdehydes, substituted propenitriles, 4-substituted isoxazoles, 2,5-dioxocyclopentane carboxaldehydes, 5-(hydroxymethylene)-1,3-dialkylbarbituric acids, 2-(ethoxymethylene)-1H-indene-1,3(2H)-diones, and 2-substituted malondialdehyde compounds.

49. The photothermographic material of claim 48 further including a contrast enhancing agent.

50. The photothermographic material of claim 49 wherein said contrast enhancing agent is selected from the group consisting of hydroxylamines, alkanolamines, ammonium phthalamate compounds, hydroxamic acids, N-acylhydrazines, and hydrogen atom donor compounds.

51. A photothermographic material comprising a support having thereon one or more layers comprising a binder and in reactive association:

a. a photocatalyst, b. a non-photosensitive source of reducible silver ions, c. a reducing composition for said reducible silver ions, d. a tellurium chemical sensitizer represented by the following Structure I or II:

$$Te(L)_m(X^1)_n \quad (I)$$

$$Pd(X^2)_2[Te(R')_2]_2 \quad (II)$$

wherein $X^1$ and $X^2$ independently represent halo, OCN, SCN, $S(C{=}S)N(R_a)(R_b)$, $S(C{=}S)OR_a$, $S(C{=}S)SR_a$, $S(P{=}S)(OR_a)(OR_b)_2$, $S(P{=}S)(R_a)(R_b)$, SeCN, TeCN, CN, $SR_a$, $OR_a$, $N_3$, alkyl, aryl, or $O(C{=}O)R_a$ groups, $R_a$ and $R_b$ are an alkyl, alkenyl, cycloalkyl, heterocycyl, or aryl group, or $R_a$ and $R_b$ taken together can form a 5-, 6- or 7-membered heterocyclic ring, L is a ligand derived from a neutral Lewis base, R' is an alkyl or aryl group, m is 0, 1, 2, or 4, and n is 2 or 4 provided that when m is 0 or 2, n is 2 or 4, and when m is 1 or 4, n is 2, and further provided that multiple $X^1$ $X^2$, L, $R_a$, $R_b$, or R' groups in the molecule can be the same or different, and e. additional chemical sensitization achieved by addition of a second chemical sensitizer that is represented by the following Structure IV, V, or VI:

(IV)

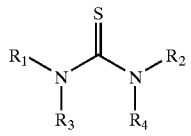

(V)

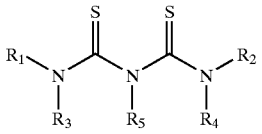

(VI)

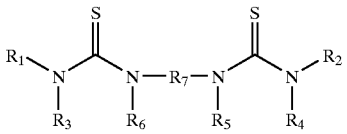

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_b$ taken together, can form a substituted or unsubstituted 5- to 7-membered heterocyclic ring, and $R_7$ is a divalent aliphatic or alicyclic linking group.

* * * * *

UNITED STATES PATENT AND TRADEMARK OFFICE

CERTIFICATE OF CORRECTION

PATENT NO. : 6,699,647 B2
DATED : March 2, 2004
INVENTOR(S) : Doreen C. Lynch et al It is certified that error appears in the above-identified patent and that said Letters Patent is hereby corrected as shown below:

Column 52,
Line 18, after "by", insert -- Structure I wherein m is 0 and n is 2, and Structure I is further represented by --

Column 52,
Line 29, after "group" insert -- and p is 2 or 4. --

Signed and Sealed this

Thirty-first Day of August, 2004

JON W. DUDAS
*Director of the United States Patent and Trademark Office*